US007316296B2

(12) United States Patent
Hashiguchi

(10) Patent No.: US 7,316,296 B2
(45) Date of Patent: Jan. 8, 2008

(54) ELEVATOR APPARATUS

(75) Inventor: Naoki Hashiguchi, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 0 days.

(21) Appl. No.: 10/535,241

(22) PCT Filed: Dec. 9, 2003

(86) PCT No.: PCT/JP03/15733

§ 371 (c)(1),
(2), (4) Date: May 18, 2005

(87) PCT Pub. No.: WO2005/056455

PCT Pub. Date: Jun. 23, 2005

(65) Prior Publication Data

US 2006/0175138 A1 Aug. 10, 2006

(51) Int. Cl.
*B66B 11/08* (2006.01)

(52) U.S. Cl. ..... 187/256; 187/254

(58) Field of Classification Search ..... 187/254, 187/256, 250

See application file for complete search history.

(56) References Cited

U.S. PATENT DOCUMENTS

| | | | | |
|---|---|---|---|---|
| 5,226,507 | A * | 7/1993 | Kawarasaki | 187/251 |
| 6,193,017 | B1 * | 2/2001 | Koster | 187/258 |
| 6,193,018 | B1 * | 2/2001 | Schroder-Brumloop et al. | 187/266 |
| 6,247,557 | B1 * | 6/2001 | Kobayashi et al. | 187/266 |
| 7,117,977 | B2 * | 10/2006 | Abe | 187/266 |
| 2006/0175138 | A1 * | 8/2006 | Hashiguchi | 187/256 |

FOREIGN PATENT DOCUMENTS

| | | | |
|---|---|---|---|
| CN | 1094887 | C | 11/2002 |
| EP | 1 006 071 | A1 | 6/2000 |
| JP | 7-117957 | | 5/1995 |
| JP | 11-246145 | | 9/1999 |
| JP | 11-310372 | | 11/1999 |
| JP | 2000-255933 | | 9/2000 |
| WO | WO 02/30801 | A1 | 4/2002 |
| WO | WO 03/104126 | A1 | 12/2003 |

OTHER PUBLICATIONS

International Search Report dated Sep. 14, 2004.
Chinese Office Action, with English-language Translation, dated Dec. 22, 2006.

* cited by examiner

*Primary Examiner*—Patrick Mackey
*Assistant Examiner*—Terrell Matthews
(74) *Attorney, Agent, or Firm*—Buchanan Ingersoll & Rooney PC

(57) ABSTRACT

In an elevator apparatus, a first driving machine having a first drive sheave and a second driving machine having a second drive sheave are disposed in an upper portion of a hoistway. A car and first and second counterweights are suspended inside the hoistway by a main rope body wound around the first and second drive sheaves. The car and the first and second counterweights are raised and lowered inside the hoistway by a driving force from the first and second driving machines.

6 Claims, 25 Drawing Sheets

ELEVATOR APPARATUS

TECHNICAL FIELD

The present invention relates to an elevator apparatus in which a driving machine for raising and lowering a car and a counterweight is disposed in an upper portion of a hoistway.

BACKGROUND ART

Conventional elevator apparatuses in which first and second hoisting machines are disposed in an upper portion of a hoistway have been disclosed in Japanese Patent Laid-Open No. HEI 7-117957 (Gazette), for example. Each of the hoisting machines has a drive sheave, and a car and a counterweight are suspended inside the hoistway by main ropes wound around these drive sheaves.

In conventional elevator apparatuses such as that described above, the hoisting machines are reduced in size by using two hoisting machines, and installation space for the apparatus as a whole is made compact by disposing the reduced hoisting machines in an upper portion inside the hoistway, but it is desirable for the installation space to be made even more compact by disposing the hoisting machines, the counterweight, etc., even more efficiently.

DISCLOSURE OF THE INVENTION

The present invention aims to solve the above problems and an object of the present invention is to provide an elevator apparatus enabling overall installation space to be made even more compact.

In order to achieve the above object, according to one aspect of the present invention, there is provided an elevator apparatus including: a first driving machine having a first drive sheave, the first driving machine being disposed in an upper portion of a hoistway; a second driving machine having a second drive sheave, the second driving machine being disposed in an upper portion of the hoistway; a car raised and lowered inside the hoistway by a driving force from the first and second driving machines; first and second counterweights raised and lowered inside the hoistway by a driving force from the first and second driving machines; and a main rope body wound around the first and second drive sheaves, the main rope body suspending the car and the first and second counterweights inside the hoistway.

According to another aspect of the present invention, there is provided an elevator apparatus including: a first driving machine having a first drive sheave, the first driving machine being disposed in an upper portion of a hoistway; a second driving machine having a second drive sheave, the second driving machine being disposed in an upper portion of the hoistway; a car raised and lowered inside the hoistway by a driving force from the first and second driving machines, the car having mutually opposite first and second side surface portions; a counterweight raised and lowered inside the hoistway by a driving force from the first and second driving machines; a main rope body wound around the first and second drive sheaves, the main rope body suspending the car and the counterweight inside the hoistway; a first car return pulley disposed in an upper portion of the hoistway, the first car return pulley directing the main rope body from the first drive sheave toward the first side surface portion; a first counterweight return pulley disposed in an upper portion of the hoistway, the first counterweight return pulley directing the main rope body from the first drive sheave to the first counterweight; a second car return pulley disposed in an upper portion of the hoistway, the second car return pulley directing the main rope body from the second drive sheave toward the second side surface portion; a second counterweight return pulley disposed in an upper portion of the hoistway, the second counterweight return pulley directing the main rope body from the second drive sheave to the second counterweight; a first deflection pulley disposed in an upper portion of the hoistway, a portion of the main rope body between the first drive sheave and the first car return pulley being wound around the first deflection pulley; a second deflection pulley disposed in an upper portion of the hoistway, a portion of the main rope body between the second drive sheave and the second car return pulley being wound around the second deflection pulley, wherein: the first and second driving machines are disposed horizontally such that axes of rotation of the first and second drive sheaves extend vertically.

According to yet another aspect of the present invention, there is provided an elevator apparatus including: a driving machine having a drive sheave, the driving machine being disposed in an upper portion of a hoistway; a car raised and lowered inside the hoistway by a driving force from the driving machine; first and second counterweights raised and lowered inside the hoistway by a driving force from the driving machine; and a main rope body wound around the drive sheave, the main rope body suspending the car and the first and second counterweights inside the hoistway, wherein: the main rope body includes: a first main rope connected to the first counterweight; and a second main rope connected to the second counterweight; and the driving machine is disposed horizontally such that an axis of rotation of the drive sheave extends vertically.

According to still yet another aspect of the present invention, there is provided an elevator apparatus including: a driving machine having a drive sheave, the driving machine being disposed in an upper portion of a hoistway; a car raised and lowered inside the hoistway by a driving force from the driving machine; a counterweight raised and lowered inside the hoistway by a driving force from the driving machine; a main rope body wound around the drive sheave, the main rope body suspending the car and the counterweight inside the hoistway; a car suspension sheave mounted to the car, the main rope body being wound around the car suspension sheave; a car return pulley disposed in an upper portion of the hoistway, the car return pulley directing the main rope body extending from the drive sheave to the car suspension sheave; and a counterweight return pulley disposed in an upper portion of the hoistway, the counterweight return pulley directing the main rope body extending from the drive sheave to the counterweight, wherein: the main rope body has: a first end portion connected to a rope connecting portion fixed to an upper portion of the hoistway; and a second end portion connected to the counterweight, the main rope body being wound sequentially around the car suspension sheave, the car return pulley, the drive sheave and the counterweight return pulley from the first end portion; and the driving machine is disposed horizontally such that an axis of rotation of the drive sheave extends vertically.

BEST MODE FOR CARRYING OUT THE INVENTION

Preferred embodiments of the present invention will now be explained with reference to the drawings.

Embodiment 1

Figure 1:
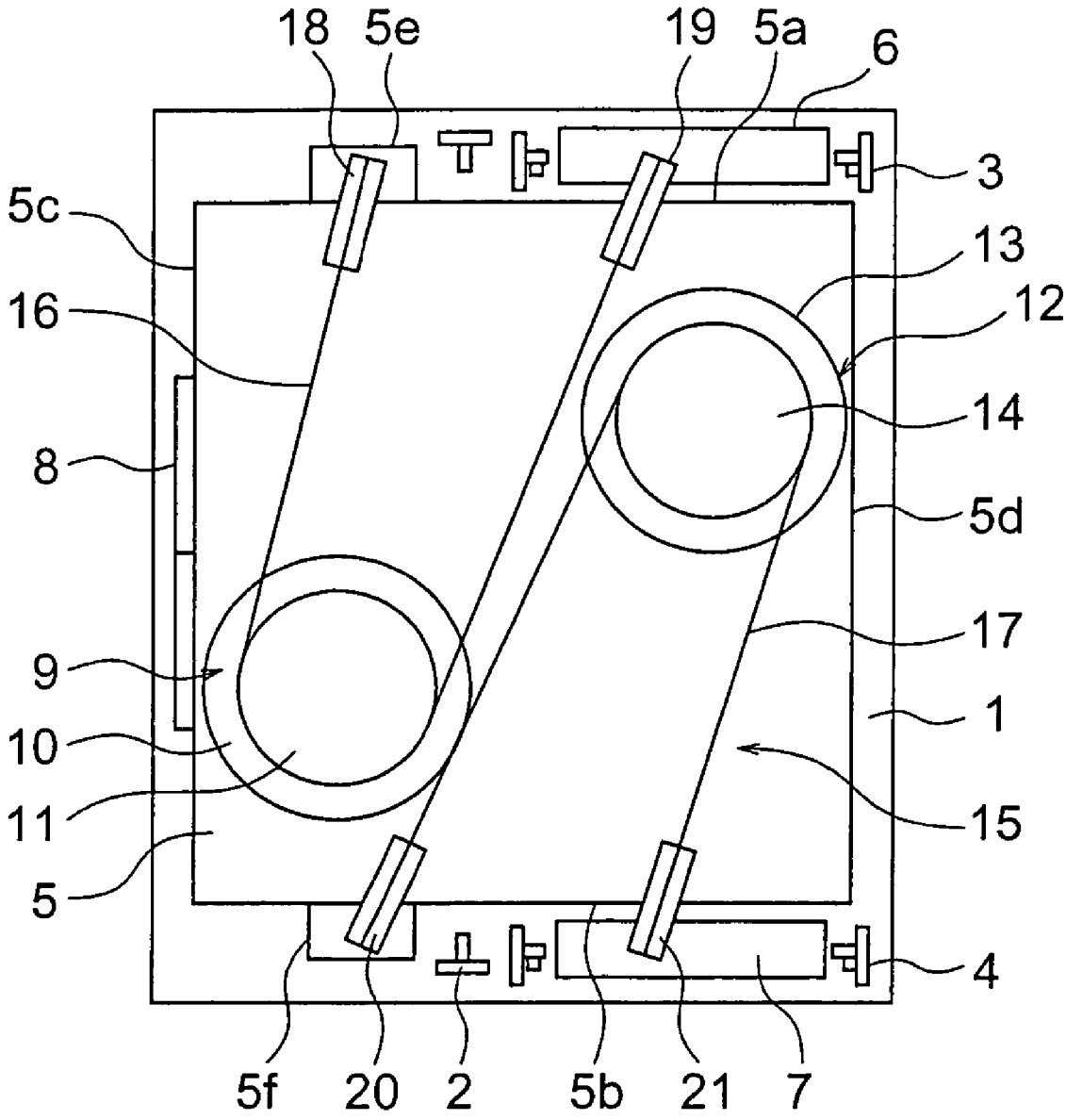
FIG. 1 is a plan showing an elevator apparatus according to Embodiment 1 of the present invention.
Figure 2:
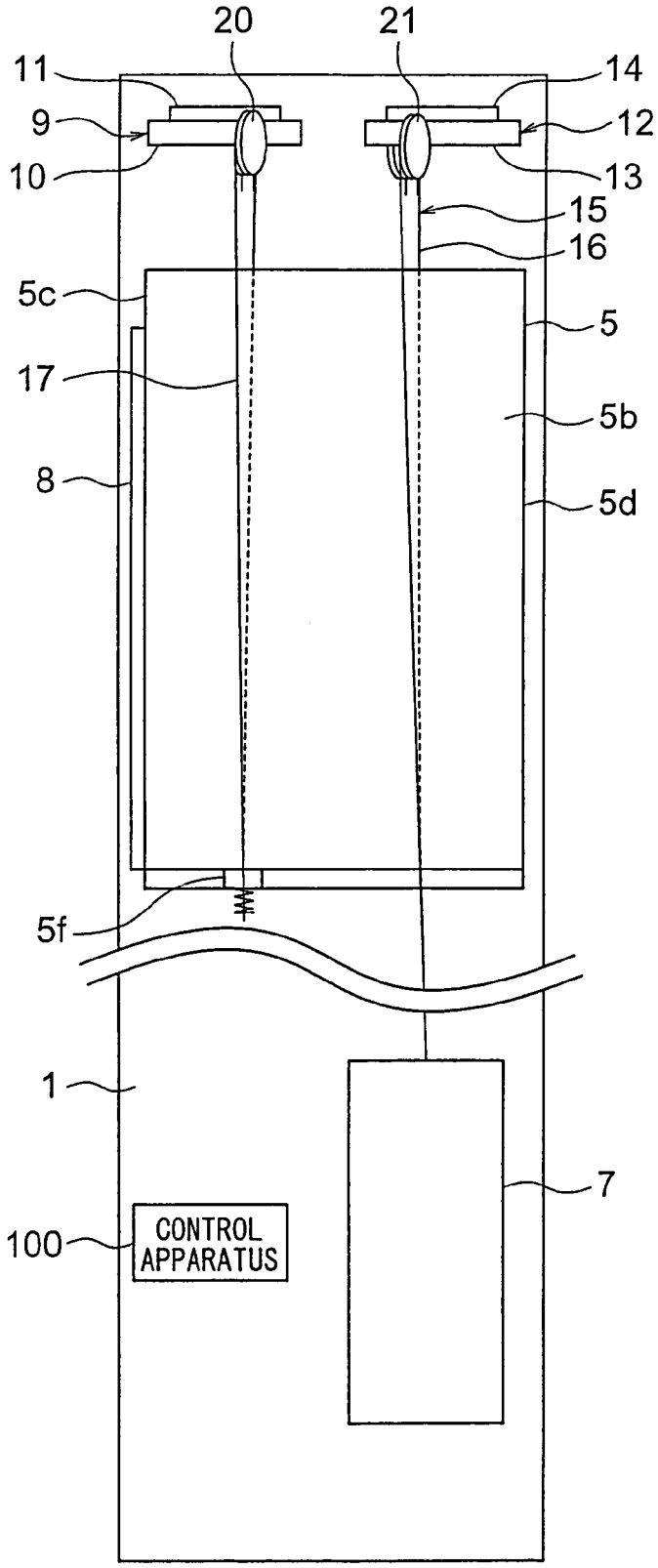
FIG. 2 is a side elevation showing the elevator apparatus in FIG. 1.

FIG. 1 is a plan showing an elevator apparatus according to Embodiment 1 of the present invention, and FIG. 2 is a side elevation showing the elevator apparatus in FIG. 1. In FIG. 1, a pair of car guide rails 2, a pair of first counterweight guide rails 3, and a pair of second counterweight guide rails 4 are installed inside a hoistway 1.

The car guide rails 2 are disposed such that an imaginary straight line connecting the two car guide rails 2 extends parallel to a direction of frontage of a landing entrance in a plane projected vertically. The first counterweight guide rails 3 are disposed such that an imaginary straight line connecting the two first counterweight guide rails 3 extends in a depth direction of the hoistway 1 in a plane projected vertically. The second counterweight guide rails 4 are disposed such that an imaginary straight line connecting the two second counterweight guide rails 4 extends in a depth direction of the hoistway 1 in a plane projected vertically. Moreover, the guide rails 2, 3, and 4 are omitted from FIG. 2.

A car 5 is guided by the car guide rails 2 so as to be raised and lowered inside the hoistway 1. A first counterweight 6 is guided by the first counterweight guide rails 3 so as to be raised and lowered inside the hoistway. A second counterweight 7 is guided by the second counterweight guide rails 4 so as to be raised and lowered inside the hoistway 1.

The car 5 has: mutually opposite first and second side surface portions 5*a* and 5*b*; a front surface portion 5*c* having a car entrance; and a back surface portion 5*d* opposite the front surface portion 5*c*. A car door 8 for opening and closing the car entrance is disposed on the front surface portion 5*c*. A first rope connecting portion 5*e* is fixed to a lower portion of the first side surface portion 5*a*, and a second rope connecting portion 5*f* is fixed to a lower portion of the second side surface portion 5*b*.

The first counterweight 6 is disposed beside the car 5 so as to face the first side surface portion 5*a*. The second counterweight 7 is disposed beside the car 5 so as to face the second side surface portion 5*b*. Specifically, the first and second counterweights 6 and 7 are disposed symmetrically to each other on first and second sides in a width direction of the car 5. The first and second counterweights 6 and 7 are disposed behind the car guide rails 2 in a depth direction of the hoistway 1.

First and second driving machines (hoisting machines) 9 and 12 for raising and lowering the car 5 and the first and second counterweights 6 and 7 are disposed in an upper portion inside the hoistway 1. The first and second driving machines 9 and 12 are disposed directly above the car 5 so as to entirely overlap with the car 5 in a plane projected vertically.

More specifically, if an upper surface of the car 5 is divided into four equal parts by an imaginary straight line dividing it into two equal parts in the width direction and an imaginary straight line dividing it into two equal parts in a depth direction, then the first driving machine 9 is disposed generally directly above a region at a front end (near the car door 8) near the second side surface portion 5*b*, and the second driving machine 12 is disposed generally directly above a region at a rear end (away from the car door 8) near the first side surface portion 5*a*.

The first driving machine 9 has: a first driving machine main body 10 including a motor and a brake; and a first drive sheave 11 rotated by the first driving machine main body 10. The second driving machine 12 has: a second driving machine main body 13 including a motor and a brake; and a second drive sheave 14 rotated by the second driving machine main body 13.

The first and second driving machines 9 and 12 are disposed horizontally (including generally horizontally) such that axes of rotation of the first and second drive sheaves 11 and 14 extend vertically (including generally vertically). Thin hoisting machines having an axial dimension that is less than a radial dimension of the drive sheaves 11 and 14 or a radial dimension of the driving machine main bodies 10 and 13 are used for the first and second driving machines 9 and 12. Here, two identical hoisting machines are used.

The first and second driving machines 9 and 12 are supported by a supporting frame (not shown). The supporting frame may also be divided into a first supporting frame for supporting the first driving machine 9, and a second supporting frame for supporting the second driving machine 12. A single unit can also be constituted by mounting the first and second driving machines 9 and 12 to a shared supporting frame.

The supporting frame can be supported by a supporting beam fixed to a building, for example, or at least one of the guide rails 2, 3, or 4. A vibration isolating member made of a rubber, etc., may also be interposed between the supporting frame and the supporting beam or the guide rail 2, 3, or 4, or between the supporting frame and the first and second driving machines 9 and 12.

A main rope body 15 for suspending the car 5 and the first and second counterweights 6 and 7 inside the hoistway 1 is wound around the first and second drive sheaves 11 and 14. The main rope body 15 has: a plurality of first main ropes 16 (only one is shown in the figures) wound around the first drive sheave 11; and a plurality of second main ropes 17 (only one is shown in the figures) wound around the second drive sheave 14.

The first main ropes 16 have: first end portions connected to the first rope connecting portion 5*e*; and second end portions connected to an upper portion of the first counterweight 6. The second main ropes 17 have: third end portions connected to the second rope connecting portion 5*f*; and fourth end portions connected to an upper portion of the second counterweight 7.

The car 5 and the first and second counterweights 6 and 7 are suspended inside the hoistway 1 by the first and second main ropes 16 and 17 using a one-to-one (1:1) roping method.

A first car return pulley 18 for directing the first main ropes 16 toward the first rope connecting portion 5*e*, a first counterweight return pulley 19 for directing the first main ropes 16 toward the first counterweight 6, a second car return pulley 20 for directing the second main ropes 17 toward the second rope connecting portion 5*f*, and a second counterweight return pulley 21 for directing the second main ropes 17 toward the second counterweight 7 are disposed in an upper portion inside the hoistway 1.

The main ropes 16 and 17 extending generally horizontally from the drive sheave 11 and 14 are redirected generally vertically downward by the return pulleys 18 through 21. For that reason, the return pulleys 18 through 21 are disposed at a height inside the hoistway 1 that is generally equal to that of the driving machines 9 and 12.

These return pulleys 18 through 21 can be supported by the supporting frame supporting the driving machines 9 and 12. The return pulleys 18 through 21 are disposed such that axes of rotation thereof are horizontal and extend obliquely relative to the depth direction of the hoistway 1. Portions of the first and second main ropes 16 and 17 between the drive sheaves 11 and 14 and the return pulleys 18 through 21 extend obliquely relative to the width direction of the car 5.

The first driving machine 9, the first rope connecting portion 5*e*, the first main ropes 16, and the return pulleys 18 and 19 and the second driving machine 12, the second rope connecting portion 5*f*, the second main ropes 17, and the return pulleys 20 and 21 are disposed centrosymmetrically to each other within a plane projected vertically. Consequently, the contact angle of the first main ropes 16 on the first drive sheave 11 and the contact angle of the second main ropes 17 on the second drive sheave 14 are equal to each other.

In other words, the first and second driving machines 9 and 12, the first and second main rope connecting portions 5*e* and 5*f*, and the first and second counterweights 6 and 7 are disposed such that the contact angle of the first main ropes 16 on the first drive sheave 11 and the contact angle of the second main ropes 17 on the second drive sheave 14 are equal to each other.

The first and second driving machines 6 and 7 are controlled by a control apparatus (control board) 100 (see FIG. 2). The control apparatus 100 can be disposed in a lower portion or an upper portion inside the hoistway 1. The control apparatus 100 may also be mounted to the supporting frame supporting the driving machines 9 and 12.

Next, action will be explained. The first and second driving machines 9 and 12 are driven in synchrony with each other by shared signals from the control apparatus 100. Thus, the first and second drive sheaves 11 and 14 are rotated in synchrony with each other to raise and lower the car 5 and the first and second counterweights 6 and 7. The direction of movement of the first and second counterweights 6 and 7 is always identical.

In an elevator apparatus of this kind, because first and second driving machines 9 and 12 are used, and first and second counterweights 6 and 7 are used, and the first and second counterweights 6 and 7 are also disposed so as to be distributed to the left and right of the car 5, the driving machines 9 and 12, and the counterweights 6 and 7, etc., can be disposed more efficiently, enabling overall installation space to be made even more compact.

Because the first and second driving machines 9 and 12 are disposed horizontally in an upper portion (a top portion) inside the hoistway 1 such that axes of rotation of the first and second drive sheaves 11 and 14 extend vertically and thin hoisting machines are used for the first and second driving machines 9 and 12, vertical dimensions of the hoistway 1 can be reduced.

In addition, because the first and second driving machines 9 and 12 are disposed directly above the car 5 so as to entirely overlap with the car 5 in a plane projected vertically, horizontal dimensions of the hoistway 1 can be reduced.

Because the driving machines 9 and 12, the main rope connecting portions 5*e* and 5*f*, and the counterweights 6 and 7 are disposed such that contact angles of the first and second main ropes 16 and 17 on the first and second drive sheaves 11 and 14 are equal to each other, the driving machines 9 and 12 can be synchronized easily, enabling the car 5 to be raised and lowered stably.

Embodiment 2

Figure 3:
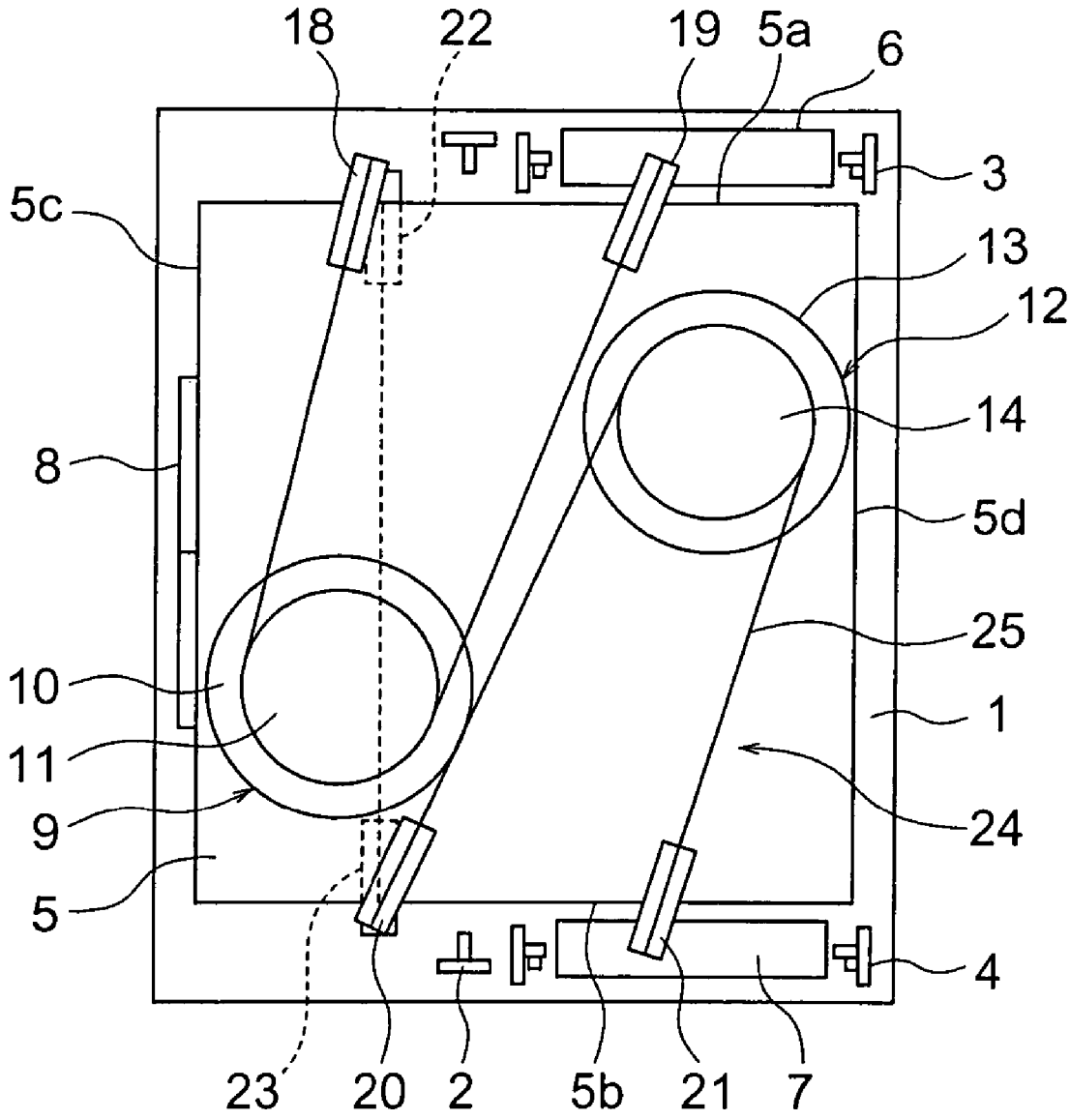
FIG. 3 is a plan showing an elevator apparatus according to Embodiment 2 of the present invention.
Figure 4:
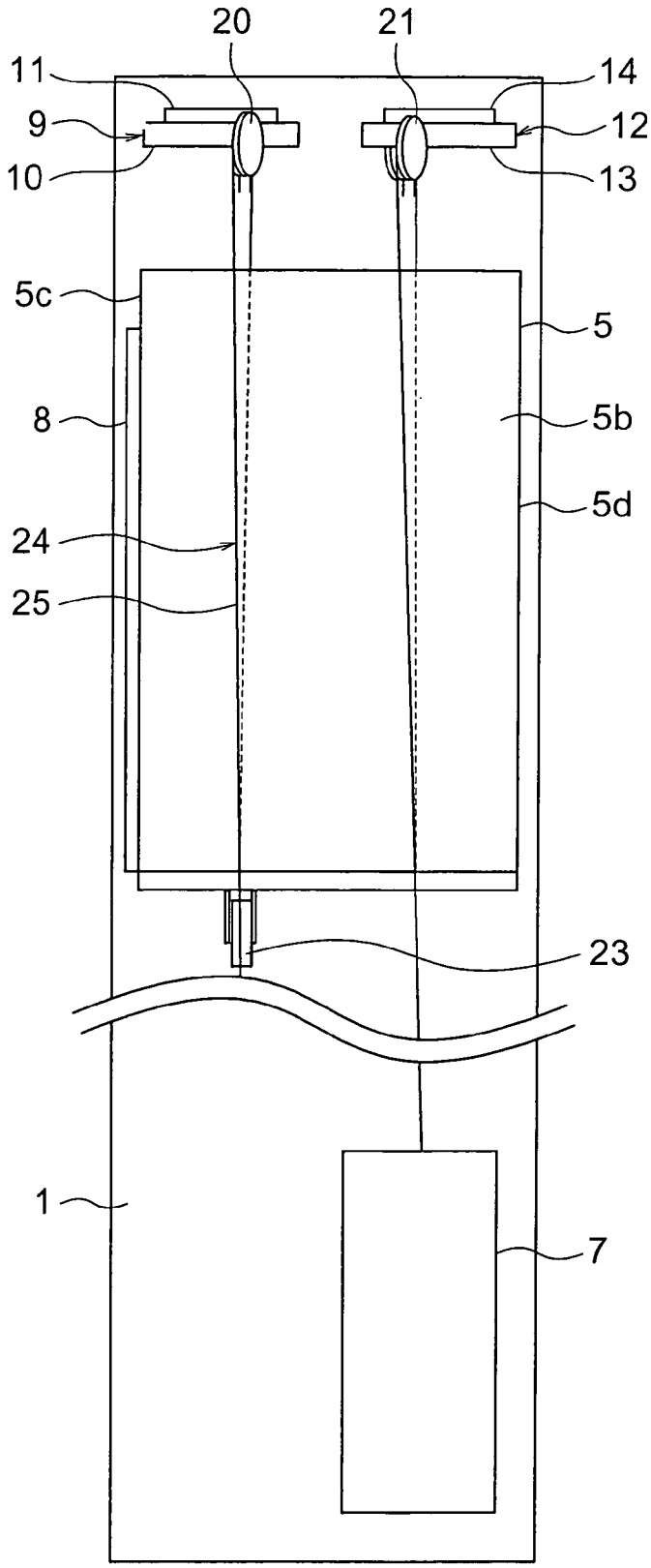
FIG. 4 is a side elevation showing the elevator apparatus in FIG. 3.

Next, FIG. 3 is a plan showing an elevator apparatus according to Embodiment 2 of the present invention, and FIG. 4 is a side elevation showing the elevator apparatus in FIG. 3. In the figures, first and second car suspension sheaves 22 and 23 are disposed at a distance from each other in a width direction of a car 5 on a lower portion of the car 5. The car suspension sheaves 22 and 23 are disposed such that axes of rotation thereof are horizontal and extend parallel to a depth direction of a hoistway 1.

The car 5 and first and second counterweights 6 and 7 are suspended inside the hoistway 1 by a main rope body 24. The main rope body 24 has a plurality of main ropes 25 (only one is shown in the figures). The main ropes 25 have: first end portions connected to the first counterweight 6; and second end portions connected to the second counterweight 7.

The main ropes 25 are wound sequentially around the first counterweight return pulley 19, the first drive sheave 11, the first car return pulley 18, the first car suspension sheave 22, the second car suspension sheave 23, the second car return pulley 20, and the second counterweight return pulley 21 from the first end portions to the second end portions.

In other words, the configuration is substantially similar to the first end portions of the first main ropes 16 and the third end portions of the second main ropes 17 according to Embodiment 1 being connected to each other at a lower portion of the car 5 and wound around the first and second car suspension sheaves 22 and 23. The rest of the configuration is similar to that of Embodiment 1.

Using an elevator apparatus of this kind, the driving machines 9 and 12, and the counterweights 6 and 7, etc., can also be disposed more efficiently, enabling overall installation space to be made even more compact.

Differences in length in the main ropes 25 to the right and left of the car 5 are also prevented from arising.

Embodiment 3

Figure 5:
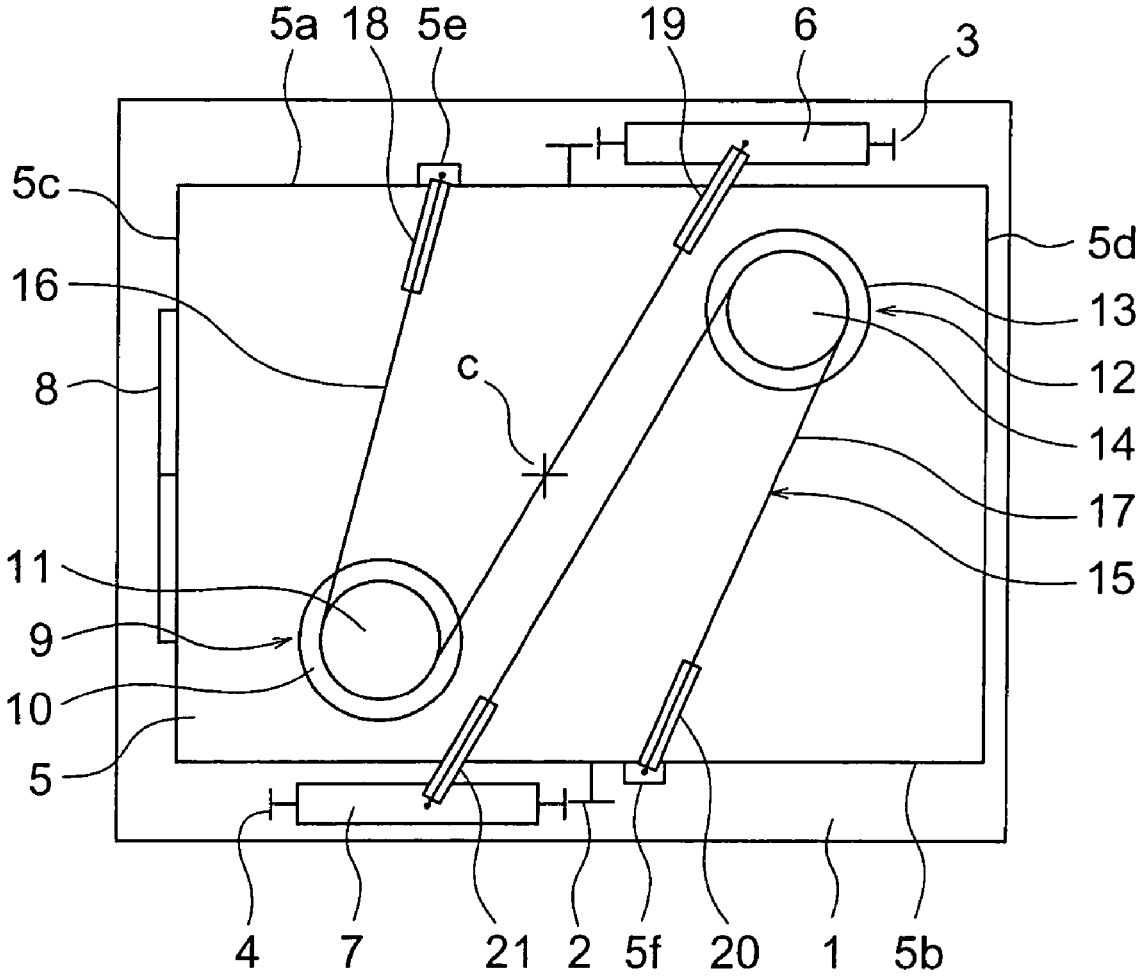
FIG. 5 is a plan showing an elevator apparatus according to Embodiment 3 of the present invention.

Next, FIG. 5 is a plan showing an elevator apparatus according to Embodiment 3 of the present invention. In this example, a second counterweight 7 is disposed in front of a car guide rail 2 in a depth direction of a hoistway 1. First and second rope connecting portions 5*e* and 5*f* are disposed such that an imaginary straight line joining the first rope connecting portion 5*e* and the second rope connecting portion 5*f* passes through a center of gravity C of a car 5 in a plane projected vertically. In other words, the car 5 is suspended substantially at its center of gravity by a main rope body 15.

Using an elevator apparatus of this kind, driving machines 9 and 12, and counterweights 6 and 7, etc., can also be disposed more efficiently, enabling overall installation space to be made even more compact. In other words, a position of disposition of the first counterweight 6 and a position of disposition of the second counterweight 7 can also be offset from each other in the depth direction of the hoistway 1.

By suspending the car 5 at its center of gravity, the car 5 can be raised and lower even more stably.

Moreover, the first driving machine 9, the first rope connecting portion 5*e*, first main ropes 16, and return pulleys 18 and 19 and the second driving machine 12, the second rope connecting portion 5*f*, second main ropes 17, and return pulleys 20 and 21 may also be disposed centrosymmetrically to each other within a plane projected vertically such that the contact angle of the first main ropes 16 relative to a first drive sheave 11 and the contact angle of the second main ropes 17 relative to a second drive sheave 14 are equal to each other.

Embodiment 4

Figure 6:
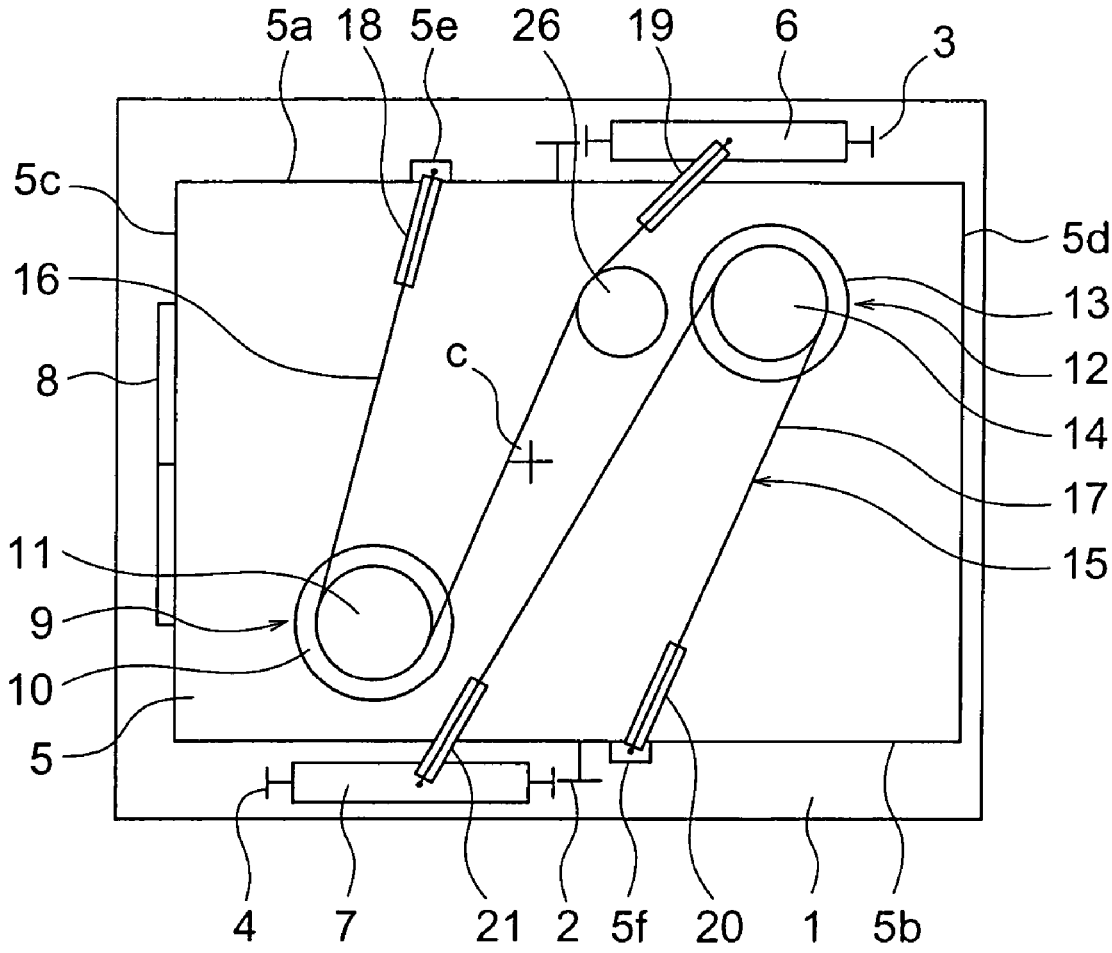
FIG. 6 is a plan showing an elevator apparatus according to Embodiment 4 of the present invention.

Next, FIG. 6 is a plan showing an elevator apparatus according to Embodiment 4 of the present invention. In the figure, an angle adjusting pulley 26 functioning as a contact angle adjusting means is disposed in an upper portion inside a hoistway 1. Portions of first main ropes 16 extending from a first drive sheave 11 to a first counterweight return pulley 19 are wound around the angle adjusting pulley 26, changing the direction of the first main ropes 16 extending from the first drive sheave 11. Thus, a contact angle of the first main ropes 16 relative to the first drive sheave 11 is increased and made equal to a contact angle of second main ropes 17 relative to a second drive sheave 14. The rest of the configuration is similar to that of Embodiment 5.

By using an angle adjusting pulley 26 in this manner, the contact angles of the first and second main ropes 16 and 17 on the first and second drive sheaves 11 and 14 are made equal to each other and the driving machines 9 and 12 can be synchronized easily, enabling the car 5 to be raised and lowered stably.

Moreover, the contact angle adjusting means may also be disposed on portions of the first main ropes 16 extending from the first drive sheave 11 to the first car return pulley 18.

The contact angle adjusting means may also be disposed on the second main ropes 16, or may also be disposed on both the first and second main ropes 16 and 17.

In addition, the contact angle adjusting means may also be used to reduce the contact angle.

Embodiment 5

Figure 7:
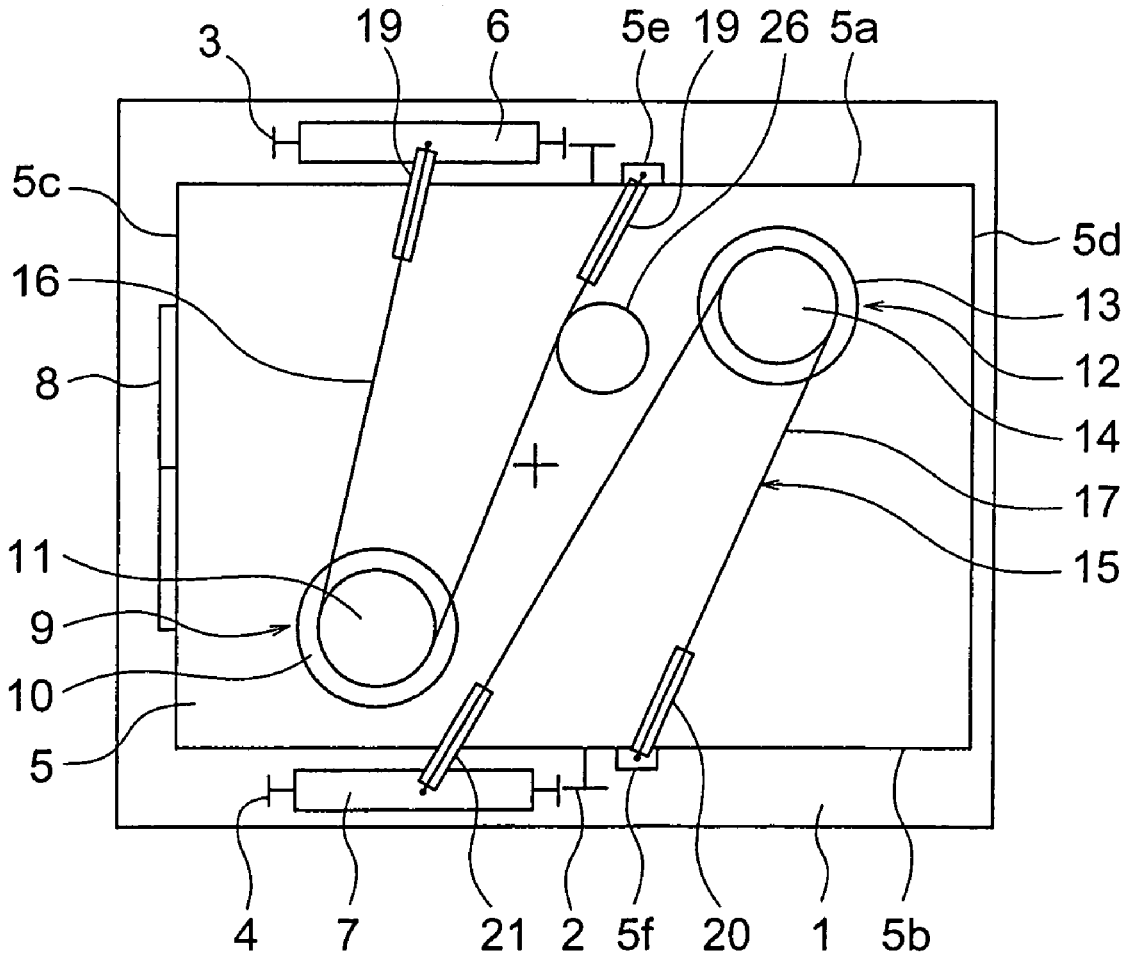
FIG. 7 is a plan showing an elevator apparatus according to Embodiment 5 of the present invention.

Next, FIG. 7 is a plan showing an elevator apparatus according to Embodiment 5 of the present invention. In this example, first and second counterweights 6 and 7 are both disposed in front of car guide rails 2 in a depth direction of a hoistway 1.

Using an elevator apparatus of this kind, driving machines 9 and 12, and the counterweights 6 and 7, etc., can also be disposed more efficiently, enabling overall installation space to be made even more compact.

By disposing both the first and second counterweights 6 and 7 in front of the car guide rails 2, equipment disposed behind the car guide rails 2 is reduced. Thus, a wide field of view can be ensured when applied to observation elevators.

Embodiment 6

Figure 8:
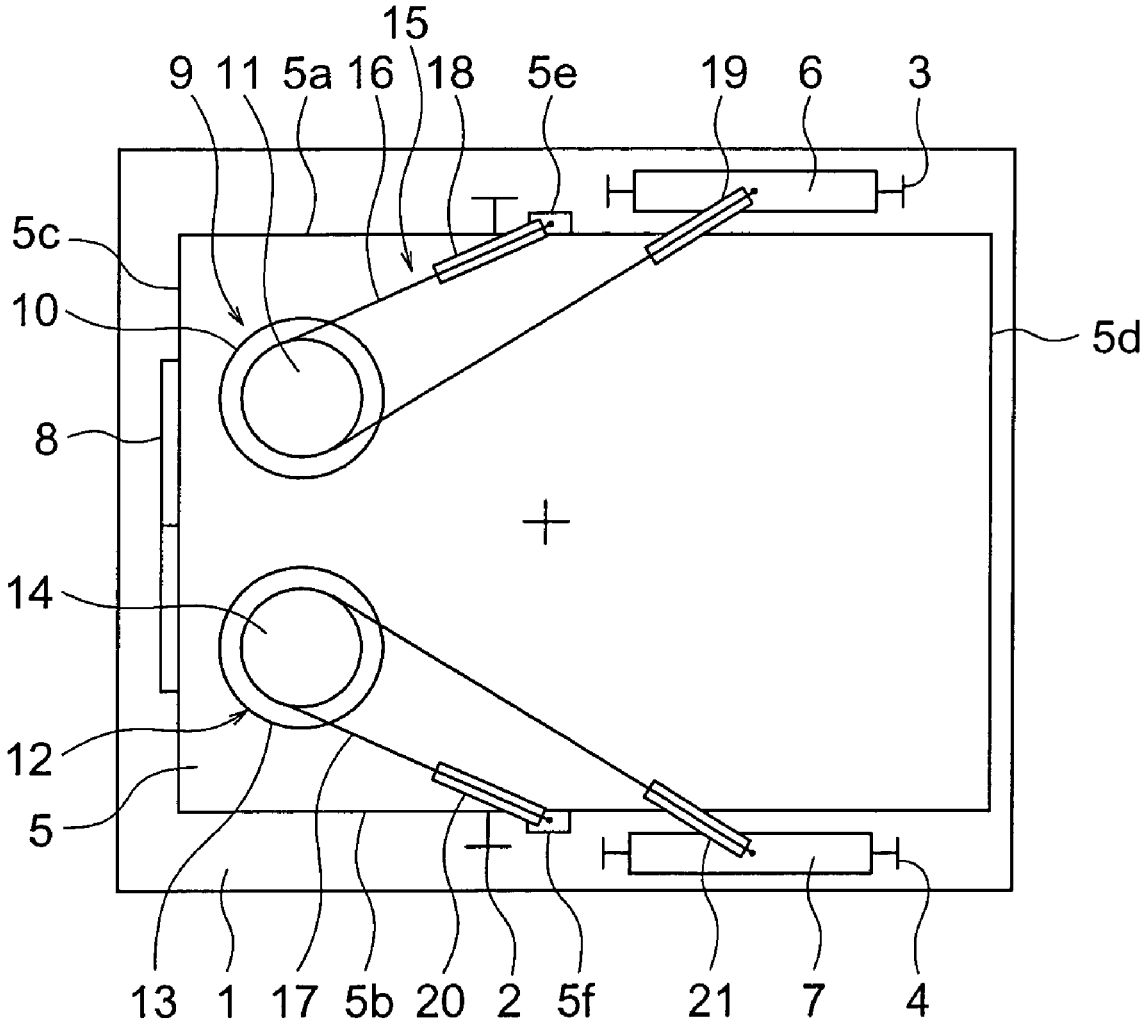
FIG. 8 is a plan showing an elevator apparatus according to Embodiment 6 of the present invention.

Next, FIG. 8 is a plan showing an elevator apparatus according to Embodiment 6 of the present invention. In this example, first and second driving machines 9 and 12 are disposed side by side in a width direction of a car 5. The first and second driving machines 9 and 12 are disposed directly above portions of the car 5 that are further forward than middle in a depth direction. First and second counterweights 6 and 7 are disposed behind car guide rails 2 in a depth direction of a hoistway 1.

In addition, the first driving machine 9, a first rope connecting portion 5*e*, first main ropes 16, and return pulleys 18 and 19 and the second driving machine 12, a second rope connecting portion 5*f*, second main ropes 17, and return pulleys 20 and 21 are disposed with linear symmetry about a center line in a width direction of the car 5.

Using an elevator apparatus of this kind, the driving machines 9 and 12, and the counterweights 6 and 7, etc., can also be disposed more efficiently, enabling overall installation space to be made even more compact.

Because the equipment is disposed with linear symmetry, adaptation to changes in width dimensions and depth dimensions of the car 5 is also facilitated.

Embodiment 7

Figure 9:
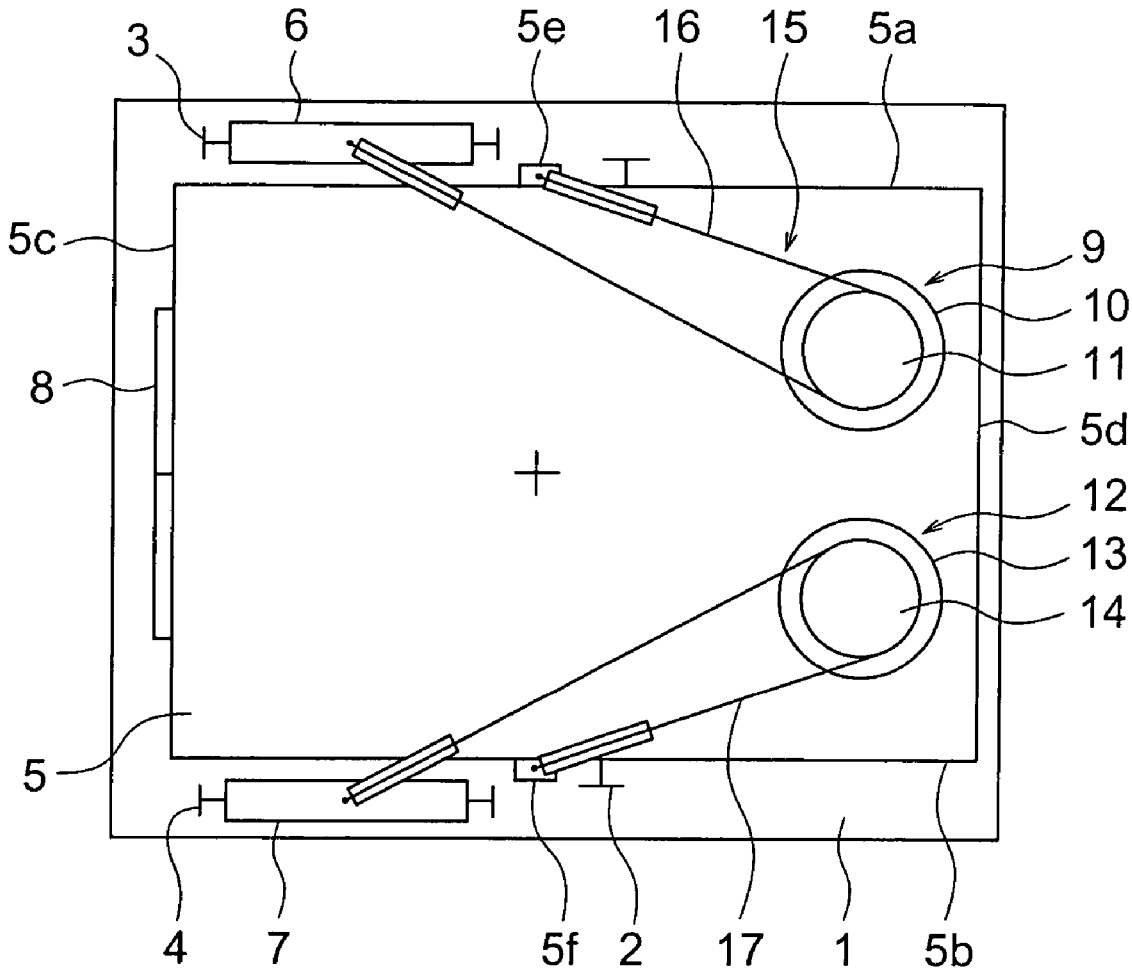
FIG. 9 is a plan showing an elevator apparatus according to Embodiment 7 of the present invention.

Next, FIG. 9 is a plan showing an elevator apparatus according to Embodiment 7 of the present invention. In this example, first and second driving machines 9 and 12 are disposed directly above portions of a car 5 that are further rearward than middle in a depth direction. First and second counterweights 6 and 7 are disposed in front of car guide rails 2 in a depth direction of the hoistway 1.

In addition, the first driving machine 9, a first rope connecting portion 5*e*, first main ropes 16, and return pulleys 18 and 19 and the second driving machine 12, a second rope connecting portion 5*f*, second main ropes 17, and return pulleys 20 and 21 are disposed with linear symmetry about a center line in a width direction of the car 5.

Using an elevator apparatus of this kind, the driving machines 9 and 12, and the counterweights 6 and 7, etc., can also be disposed more efficiently, enabling overall installation space to be made even more compact.

Embodiment 8

Figure 10:
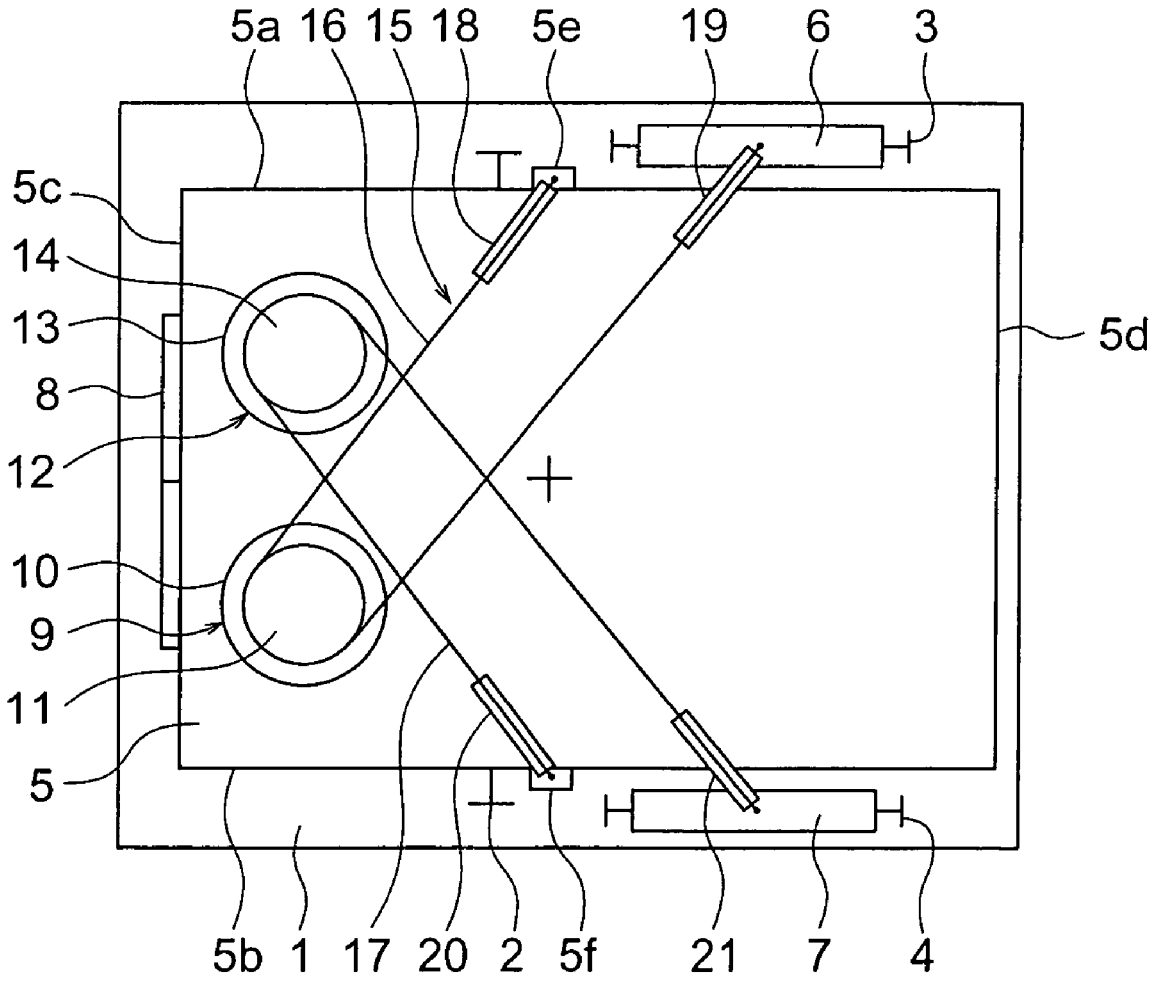
FIG. 10 is a plan showing an elevator apparatus according to Embodiment 8 of the present invention.

Next, FIG. 10 is a plan showing an elevator apparatus according to Embodiment 8 of the present invention. In this example, first and second driving machines 9 and 12 are disposed such that first main ropes 16 and second main ropes 17 cross. The rest of the configuration is similar to that of Embodiment 6.

Using an elevator apparatus of this kind, the driving machines 9 and 12, and the counterweights 6 and 7, etc., can also be disposed more efficiently, enabling overall installation space to be made even more compact.

Embodiment 9

Figure 11:
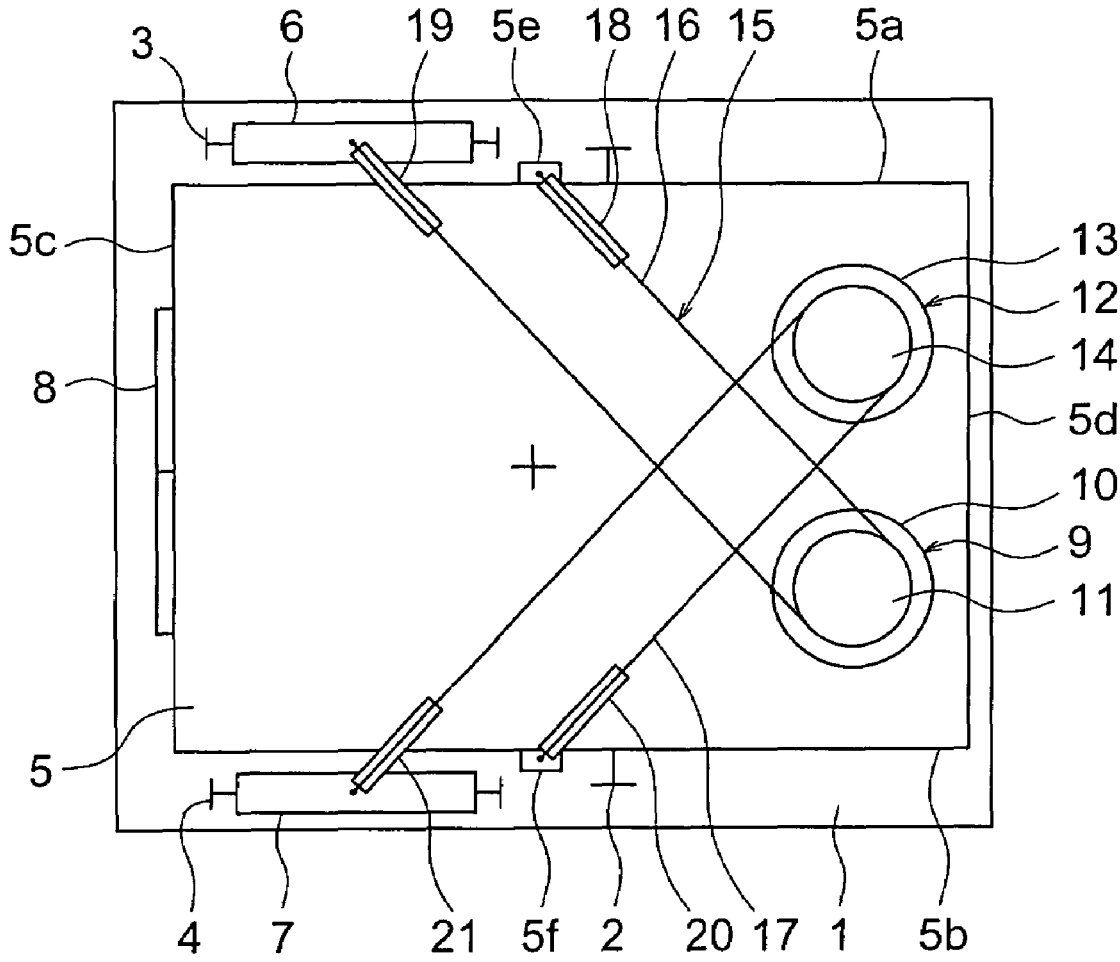
FIG. 11 is a plan showing an elevator apparatus according to Embodiment 9 of the present invention.

Next, FIG. 11 is a plan showing an elevator apparatus according to Embodiment 9 of the present invention. In this example, first and second driving machines 9 and 12 are disposed such that first main ropes 16 and second main ropes 17 cross. The rest of the configuration is similar to that of Embodiment 7.

Using an elevator apparatus of this kind, the driving machines 9 and 12, and the counterweights 6 and 7, etc., can also be disposed more efficiently, enabling overall installation space to be made even more compact.

Moreover, in Embodiments 8 and 9, in order to avoid interference between the first main ropes 16 and the second main ropes 17, the positions of disposition of the first and second driving machines 9 and 12 may also be offset in a vertical direction, or the positions of disposition of the return pulleys 18 and 19 and the positions of disposition of the return pulleys 20 and 21 may also be offset in a vertical direction, etc.

Embodiment 10

Figure 12:
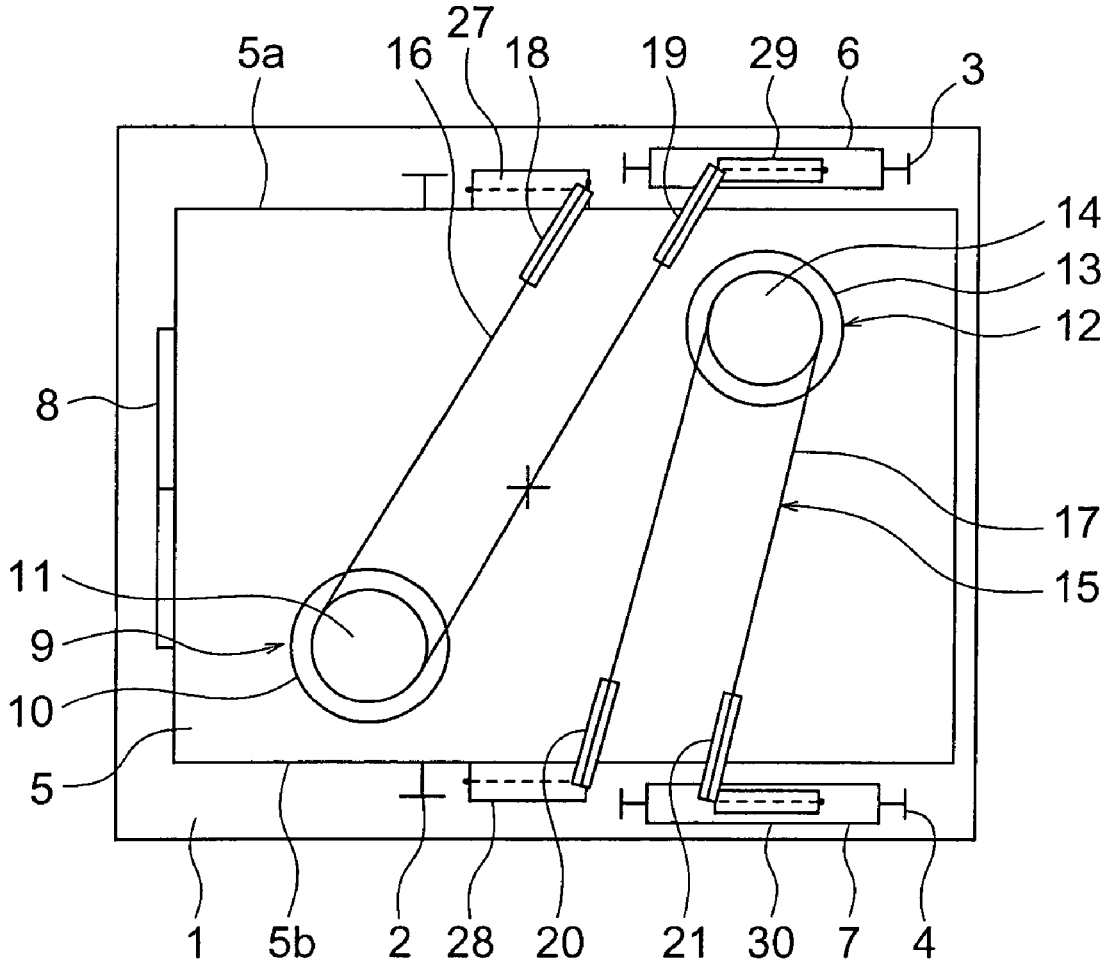
FIG. 12 is a plan showing an elevator apparatus according to Embodiment 10 of the present invention.
Figure 13:
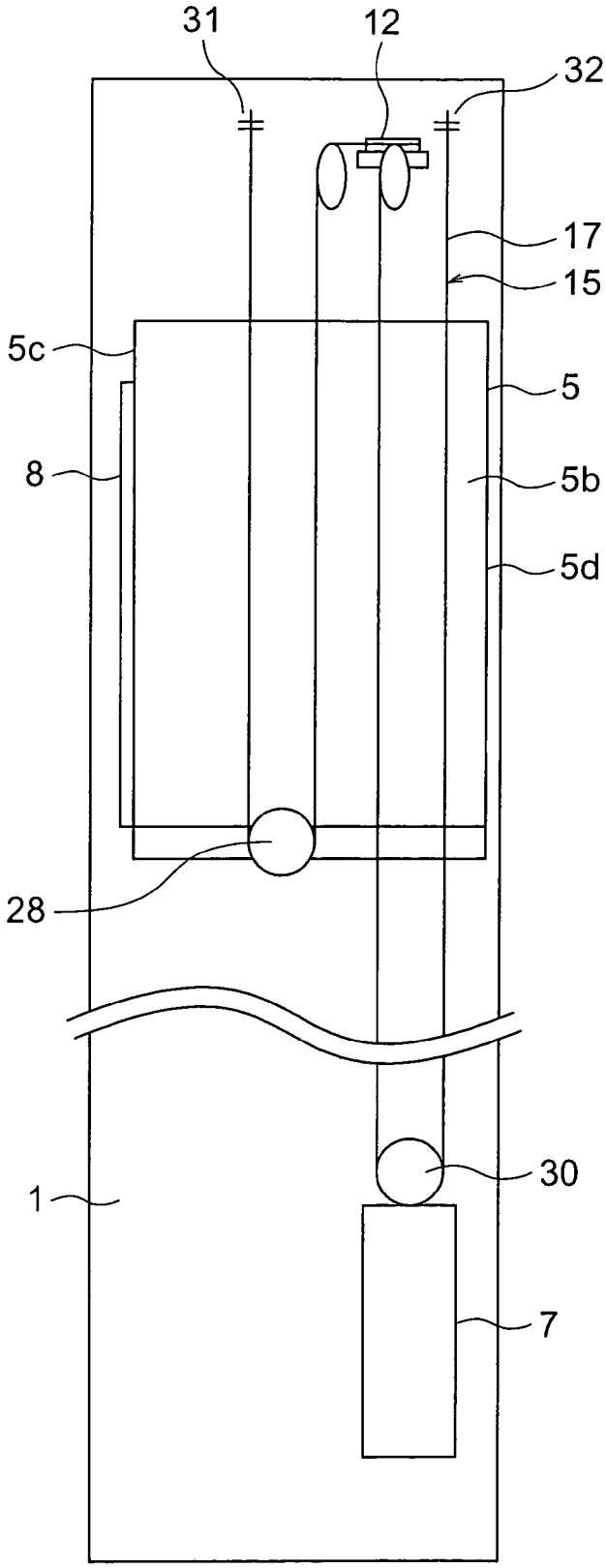
FIG. 13 is a side elevation showing the elevator apparatus in FIG. 12.

Next, FIG. 12 is a plan showing an elevator apparatus according to Embodiment 10 of the present invention, and FIG. 13 is a side elevation showing the elevator apparatus in FIG. 12. First and second car suspension sheaves 27 and 28 are disposed on a lower portions of first and second side surface portions 5*a* and 5*b* of a car 5. The first and second car suspension sheaves 27 and 28 are disposed such that axes of rotation thereof are horizontal and extend parallel to a width direction of the car 5. The first and second car suspension sheaves 27 and 28 are disposed such that an imaginary straight line connecting the axes of rotation of the first and second car suspension sheaves 27 and 28 passes through a center of gravity of the car 5 in a plane projected vertically.

A first counterweight suspension sheave 29 is disposed on an upper portion of a first counterweight 6. A second counterweight suspension sheave 30 is disposed on an upper portion of a second counterweight 7.

First main ropes 16 have first and second end portions connected to upper portions inside a hoistway 1. Second main ropes 17 have third and fourth end portions connected to upper portions inside the hoistway 1. The first and third end portions are connected to a rope connecting portion 31 fixed to an upper portion inside the hoistway 1. The second and fourth end portions are connected to a rope connecting portion 32 fixed to an upper portion inside the hoistway 1. The rope connecting portions 31 and 32 are disposed on a supporting frame on which driving machines 9 and 12 are supported, for example.

The first main ropes 16 are wound sequentially around the first car suspension sheave 27, a first car return pulley 18, a first drive sheave 11, a first counterweight return pulley 19, and the first counterweight suspension sheave 29 from the first end portions to the second end portions.

The second main ropes 17 are wound sequentially around the second car suspension sheave 28, a second car return pulley 20, a second drive sheave 14, a second counterweight return pulley 21, and the second counterweight suspension sheave 30 from the third end portions to the fourth end portions.

The car 5 and the first and second counterweights 6 and 7 are suspended inside the hoistway 1 by the first and second main ropes 16 and 17 using a two-to-one (2:1) roping method.

Using an elevator apparatus adopting a two-to-one (2:1) roping method in this manner, the driving machines 9 and 12, and the counterweights 6 and 7, etc., can also be disposed more efficiently, enabling overall installation space to be made even more compact.

Moreover, the two-to-one (2:1) roping method can also be applied to the elevator apparatuses shown in Embodiments 1, and 3 through 9 by disposing car suspension sheaves and first and second counterweight suspension sheaves as shown in Embodiment 10.

In the layouts shown in Embodiments 1 through 10, portions of the main ropes extending from the drive sheaves toward the car and portions extending toward the counterweights may also be disposed so as to be crossed without interfering with each other and directed toward the car return pulleys and the counterweight return pulleys.

Embodiment 11

Figure 14:
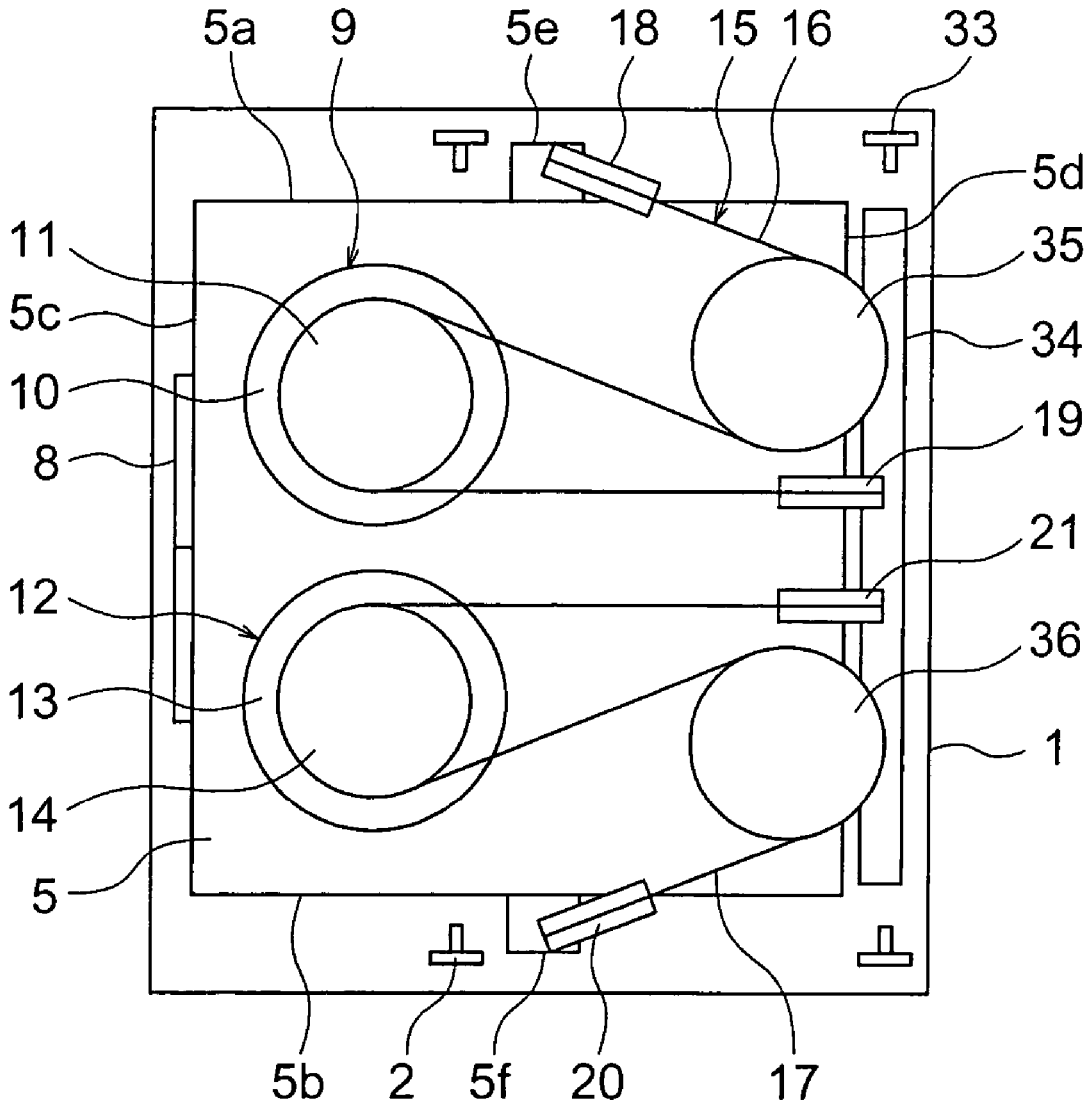
FIG. 14 is a plan showing an elevator apparatus according to Embodiment 11 of the present invention.
Figure 15:
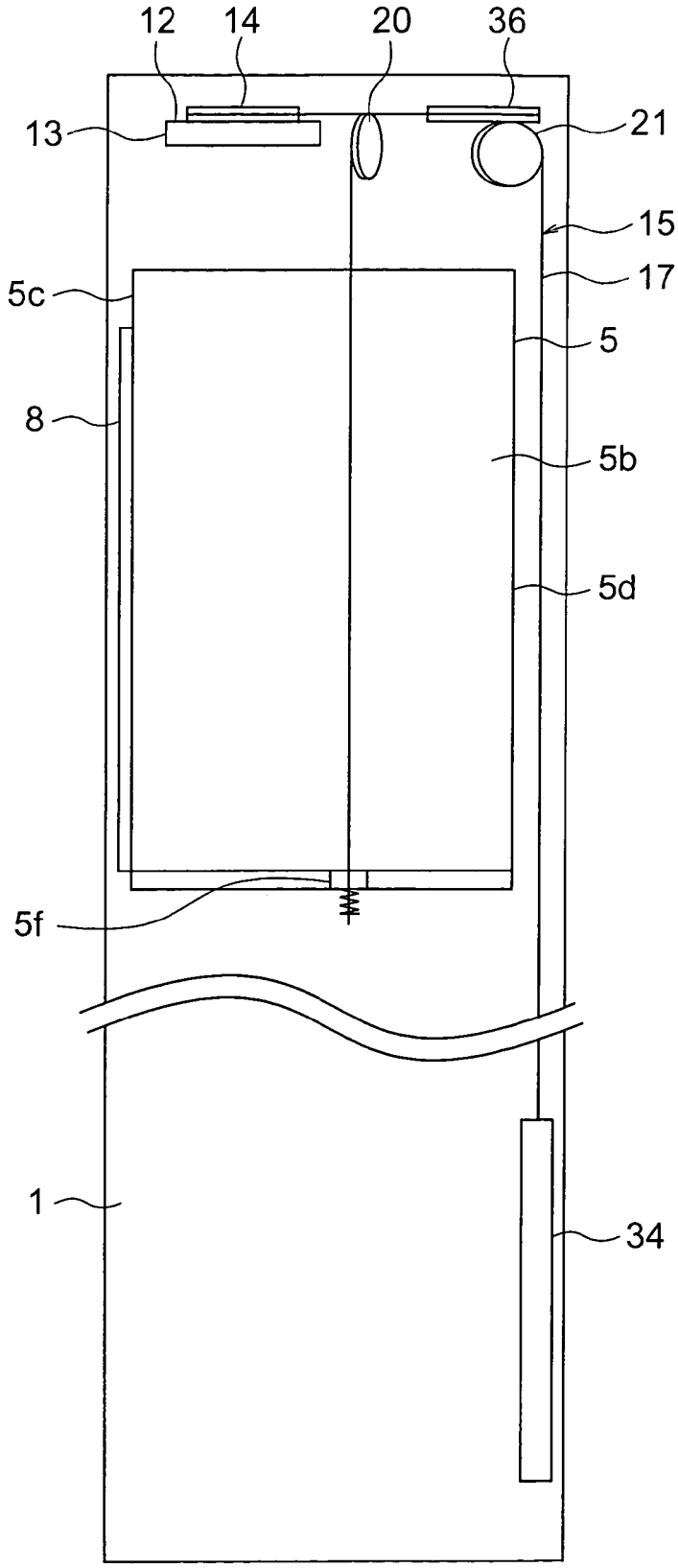
FIG. 15 is a side elevation showing the elevator apparatus in FIG. 14.

Next, FIG. 14 is a plan showing an elevator apparatus according to Embodiment 11 of the present invention, and FIG. 15 is a side elevation showing the elevator apparatus in FIG. 14. In the figures, a pair of counterweight guide rails 33 are installed inside a hoistway 1. The counterweight guide rails 33 are disposed such that an imaginary straight line connecting the two counterweight guide rails 33 extends parallel to a direction of frontage of a landing entrance in a plane projected vertically.

A counterweight 34 is guided by the counterweight guide rails 33 so as to be raised and lowered inside the hoistway 1. In Embodiments 1 through 10, two counterweights 6 and 7 were used, but in Embodiment 11, a single counterweight 34 is used.

The counterweight 34 is disposed behind a car 5 so as to face a back surface portion 5*d*. Consequently, first and second counterweight return pulleys 19 and 21 are disposed above the back surface portion 5*d* and the counterweight 34. Portions of main ropes 16 and 17 extending from drive sheaves 11 and 14 to the counterweight return pulleys 19 and 21 extend parallel to a depth direction of the car 5.

A first deflection pulley 35 onto which the first main ropes 16 are wound, and a second deflection pulley 36 onto which the second main ropes 17 are wound are disposed in an upper portion inside the hoistway 1. The first and second deflection pulleys 35 and 36 are disposed such that axes of rotation thereof extend vertically or generally vertically.

The first and second deflection pulleys 35 and 36 direct the first and second main ropes 16 and 17 from the drive sheaves 11 and 14 to car return pulleys 18 and 20. By passing the main ropes 16 and 17 through the deflection pulleys 35 and 36, the contact angle of the main ropes 16 and 17 on the drive sheaves 11 and 14 is increased.

In addition, a first driving machine 9, a first rope connecting portion 5*e*, the first main ropes 16, the first deflection pulley 35, and the return pulleys 18 and 19 and a second driving machine 12, a second rope connecting portion 5*f*, the second main ropes 17, the second deflection pulley 36, and the return pulleys 20 and 21 are disposed with linear symmetry about a center line in a width direction of the car 5.

Using an elevator apparatus of this kind, the driving machines 9 and 12, and the counterweight 34, etc., can also be disposed more efficiently, enabling overall installation space to be made even more compact.

Because the equipment is disposed with linear symmetry, adaptation to changes in width dimensions and depth dimensions of the car 5 is also facilitated.

Embodiment 12

Figure 16:
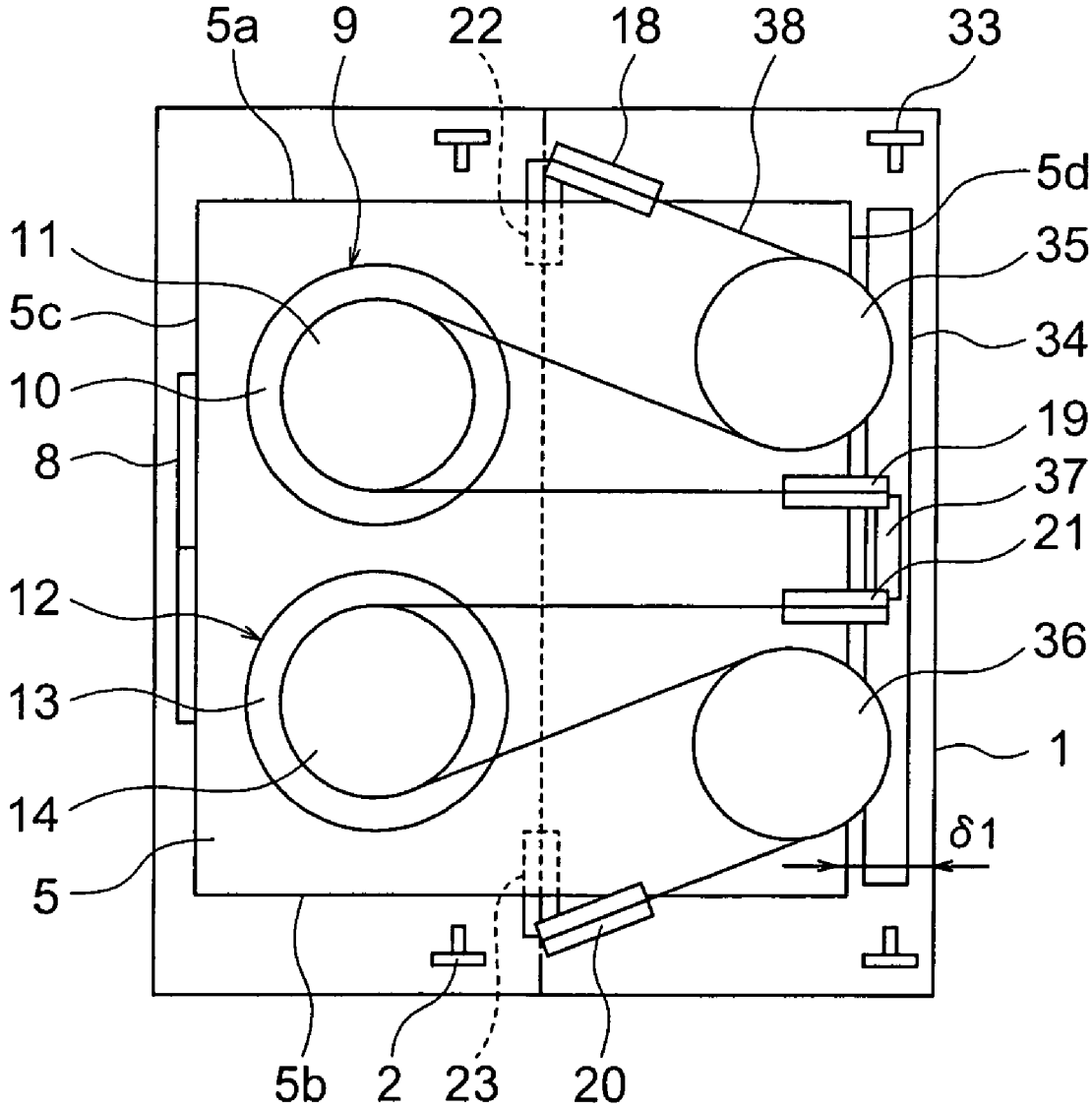
FIG. 16 is a plan showing an elevator apparatus according to Embodiment 12 of the present invention.
Figure 17:
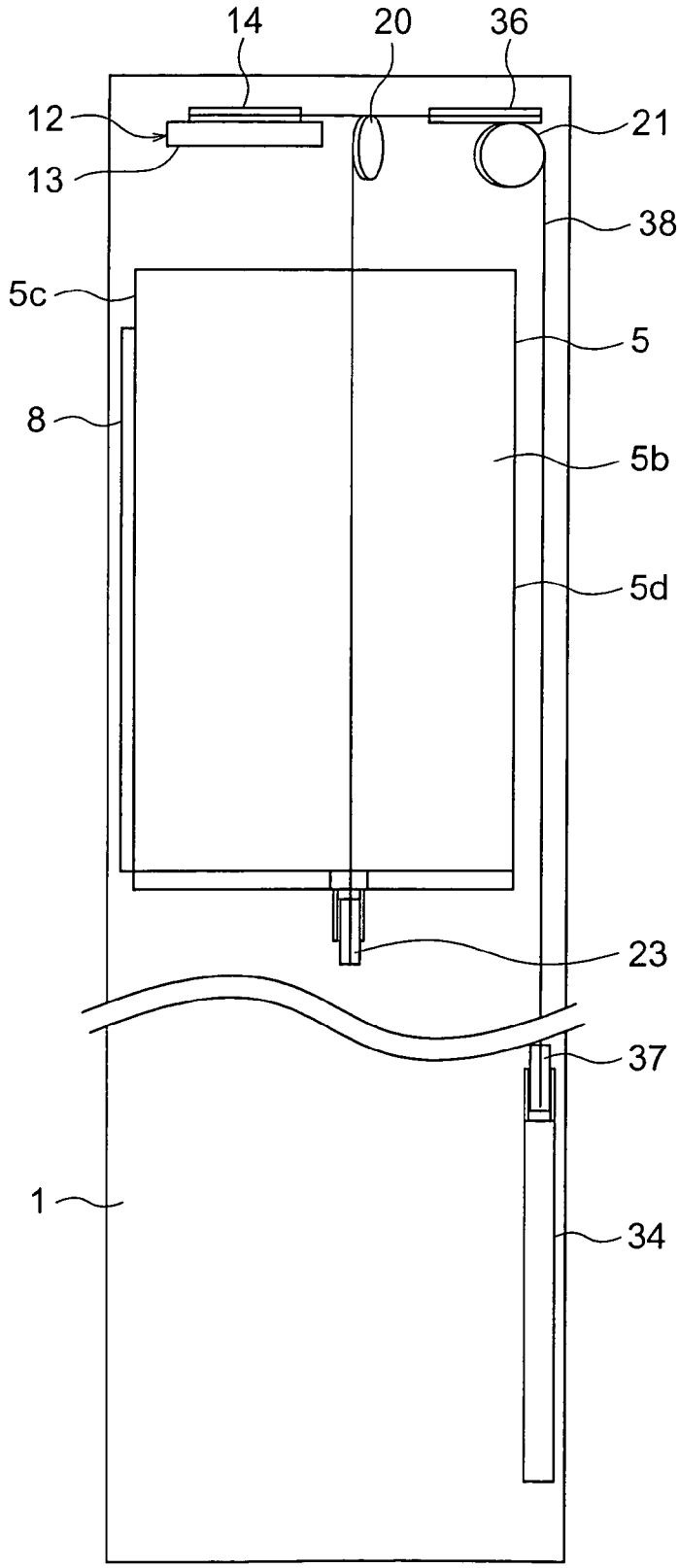
FIG. 17 is a side elevation showing the elevator apparatus in FIG. 16.

Next, FIG. 16 is a plan showing an elevator apparatus according to Embodiment 12 of the present invention, and FIG. 17 is a side elevation showing the elevator apparatus in FIG. 16. In this example, first and second car suspension sheaves 22 and 23 are mounted to lower portions of a car 5, and a counterweight suspension sheave 37 is mounted to an upper portion of a counterweight 34.

A main rope body has a plurality of endless main ropes 38 (only one is shown in the figures). The main ropes 38 are wound sequentially from a first drive sheave 11 around a first deflection pulley 35, a first car return pulley 18, the first car suspension sheave 22, the second car suspension sheave 23, a second car return pulley 20, a second deflection pulley 36, a second drive sheave 14, a second counterweight return pulley 21, the counterweight suspension sheave 37, and a first counterweight return pulley 19 and return to the first drive sheave 11.

Using an elevator apparatus of this kind, the driving machines 9 and 12, and the counterweight 34, etc., can also be disposed more efficiently, enabling overall installation space to be made even more compact.

Here, in Embodiments 1 through 12, elevator apparatuses using first and second driving machines 9 and 12 have been shown, but the control method for the two driving machines 9 and 12 is not simply limited only to operating modes in which the two are driven simultaneously. Control apparatuses may also be used that include, for example: double operating modes in which the two are driven simultaneously; and single operating modes in which only one is driven. Thus, when each driving machine 9 and 12 is being inspected and maintained individually, the driving machine that is not being inspected and maintained can be driven in a single operating mode.

Double operating modes and single operating modes may also be switched in response to load on the car. In other words, double operating modes may be implemented when the difference between the load on the car and the load of the counterweight is great, and single operating modes may be implemented when the difference between the load on the car and the load of the counterweight is small. In that case, in the single operating modes, the drive sheave of the driving machine not being driven is idled with a brake released.

In addition, control apparatuses may also be used that include: operating modes in which the two driving machines 9 and 12 are driven by identical drive command signals (operating pattern signals); and operating modes in which the driving machines 9 and 12 are driven by two mutually-independent drive command signals generated separately for each of the driving machines 9 and 12, respectively.

Moreover, in the above examples, cases in which there are two driving machines are shown, but three or more driving machines may also be used. A plurality of driving machines having mutually-different sizes may also be used.

The number of counterweights may also be three or more. A plurality of counterweights having mutually-different sizes may also be used.

Embodiment 13

Figure 18:
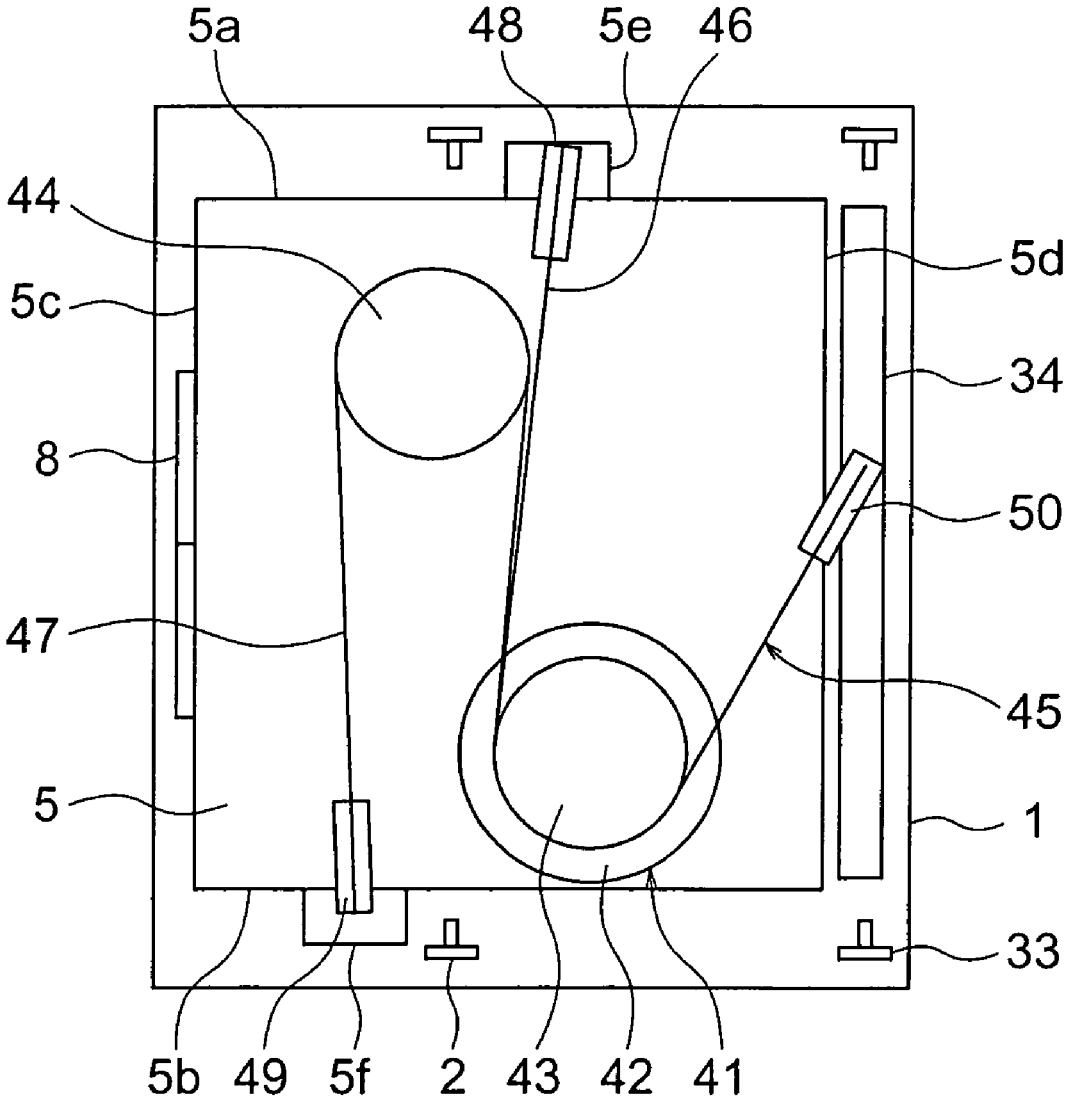
FIG. 18 is a plan showing an elevator apparatus according to Embodiment 13 of the present invention.
Figure 19:
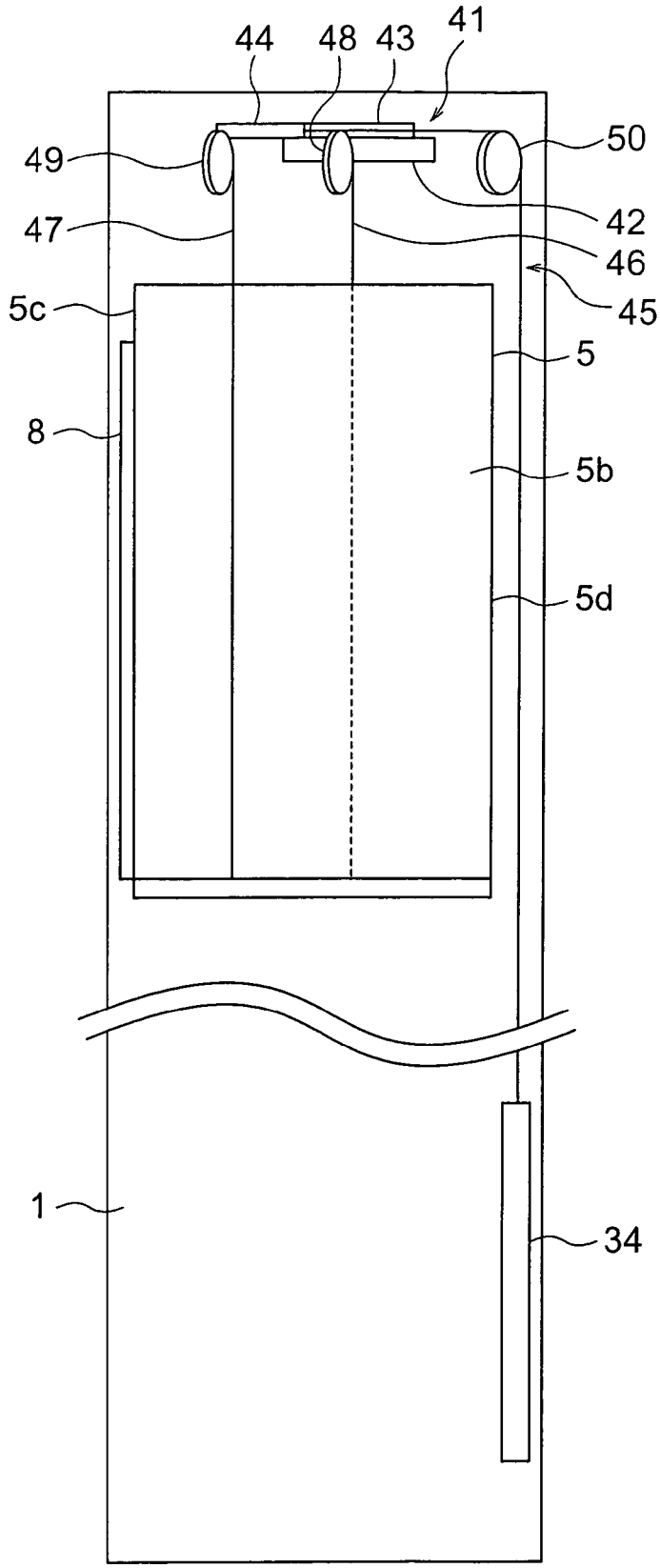
FIG. 19 is a side elevation showing the elevator apparatus in FIG. 18.

Next, FIG. 18 is a plan showing an elevator apparatus according to Embodiment 13 of the present invention, and FIG. 19 is a side elevation showing the elevator apparatus in FIG. 18. In the figures, a driving machine (thin hoisting machine) 41 is disposed in an upper portion inside a hoistway 1. The driving machine 41 has: a driving machine main body 42 including a motor and a brake; and a drive sheave 43 rotated by the driving machine main body 42. The driving machine 41 is disposed horizontally (including generally horizontally) such that an axis of rotation of the drive sheave 43 extends vertically (including generally vertically).

A car deflection pulley 44 is disposed in an upper portion inside the hoistway 1. The car deflection pulley 44 is disposed such that an axis of rotation thereof extends vertically (including generally vertically). A main rope body 45 is wound around the drive sheave 43. A car 5 and a counterweight 34 are suspended inside the hoistway 1 by the main rope body 45.

The main rope body 45 has: a plurality of first main ropes 46 (only one is shown in the figures); and a plurality of second main ropes 47 (only one is shown in the figures). The first main ropes 46 have: first end portions connected to a first rope connecting portion 5*e*; and second end portions connected to an upper portion of the counterweight 34. The second main ropes 47 have: third end portions connected to a second rope connecting portion 5*f*; and fourth end portions connected to an upper portion of the counterweight 34.

A first car return pulley 48 for directing the first main ropes 46 toward the first rope connecting portion 5*e*, a second car return pulley 49 for directing the second main ropes 47 toward the second rope connecting portion 5*f*, and a counterweight return pulley 50 for directing the first and second main ropes 46 and 47 toward the counterweight 34 are disposed in an upper portion inside the hoistway 1. The return pulleys 48 through 50 are disposed such that axes of rotation thereof extend horizontally.

Portions of the second main ropes 47 between the drive sheave 43 and the second car return pulley 49 are wound around the car deflection pulley 44.

The first rope connecting portion 5*e* is disposed behind a car guide rail 2, and the second rope connecting portion 5*f* is disposed in front of a car guide rail 2.

Using an elevator apparatus of this kind, the driving machine 41, and the counterweight 34, etc., can also be disposed more efficiently, enabling overall installation space to be made even more compact.

Embodiment 14

Figure 20:
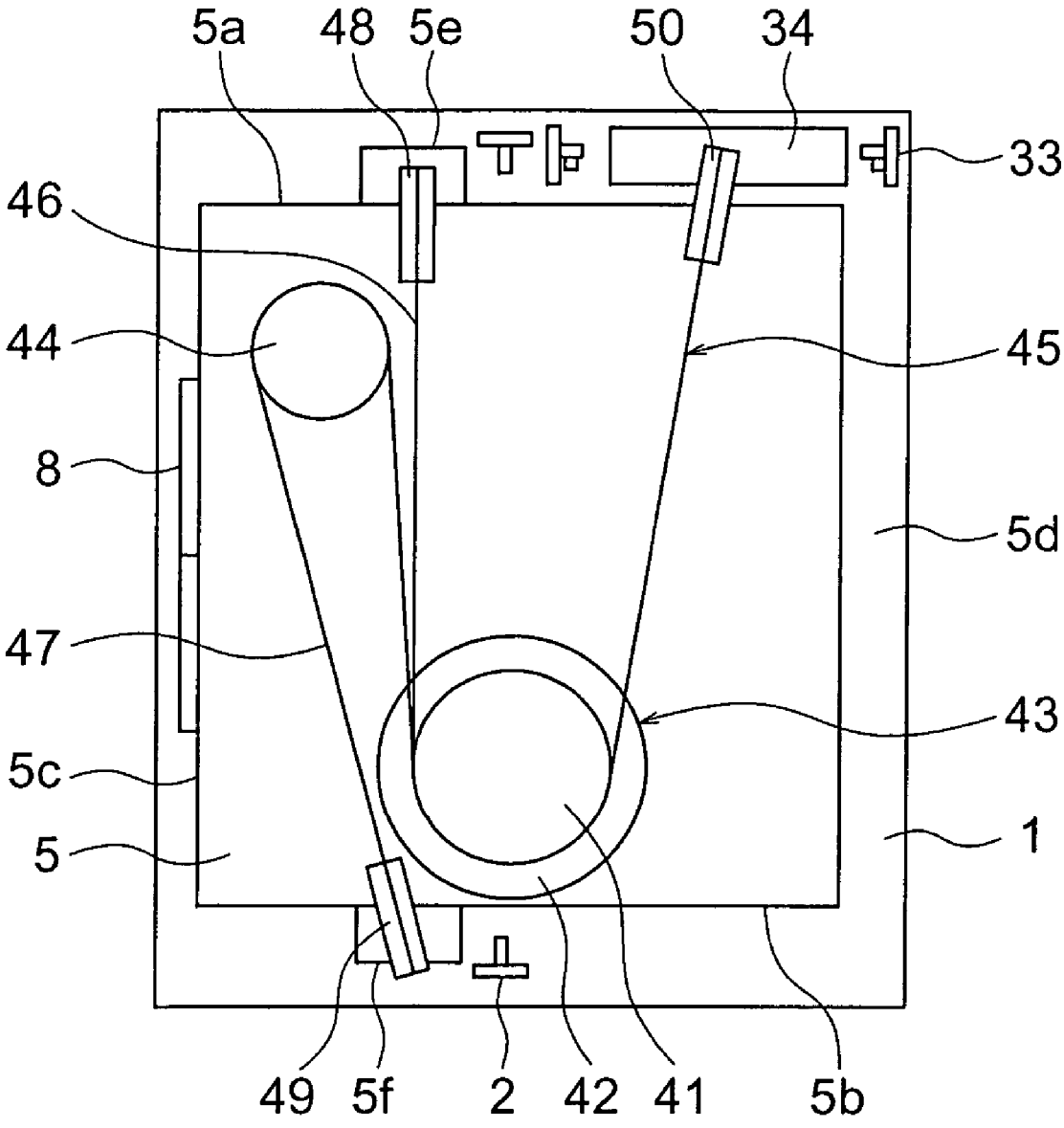
FIG. 20 is a plan showing an elevator apparatus according to Embodiment 14 of the present invention.
Figure 21:
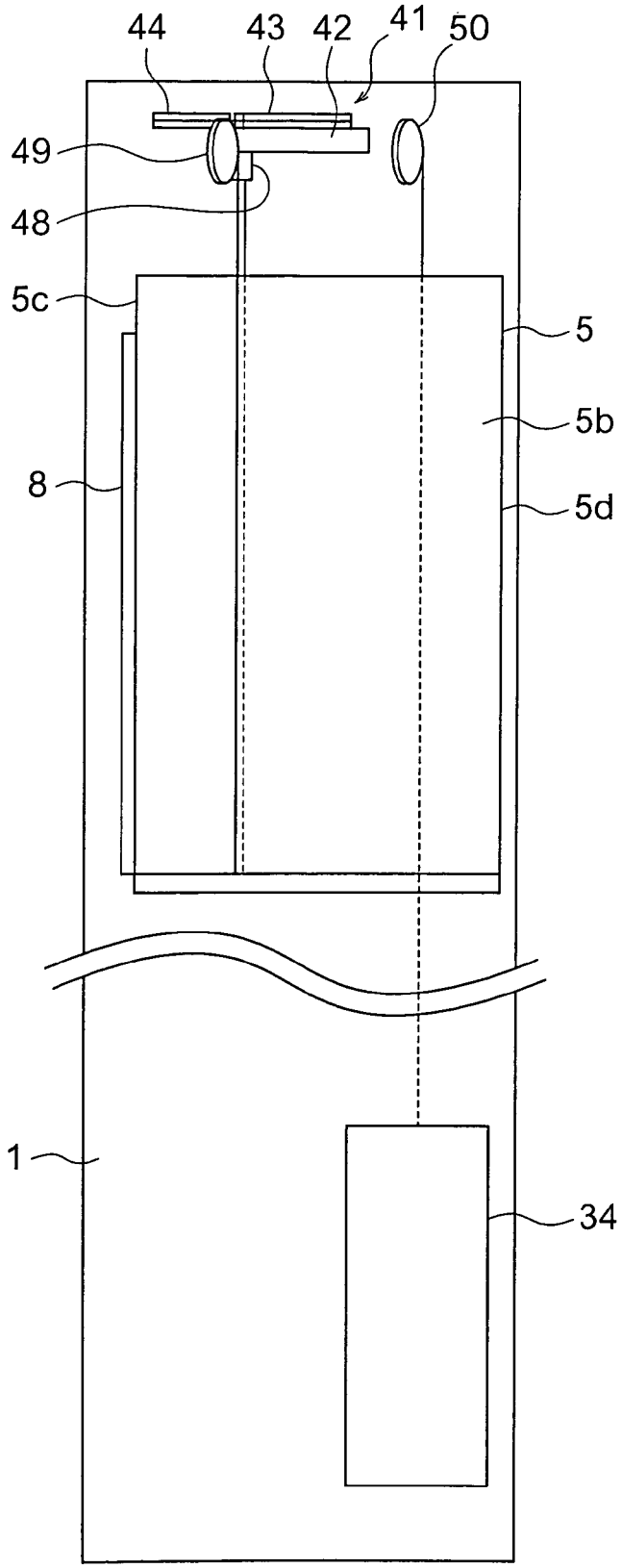
FIG. 21 is a side elevation showing the elevator apparatus in FIG. 20.

Next, FIG. 20 is a plan showing an elevator apparatus according to Embodiment 14 of the present invention, and FIG. 21 is a side elevation showing the elevator apparatus in FIG. 20. In this example, a width dimension of a counterweight 34 is reduced compared to Embodiment 13, and the counterweight 34 is disposed near a first side surface portion 5*a* of a car 5. First and second rope connecting portions 5*e* and 5*f* are disposed in front of car guide rails 2.

Even if the counterweight 34 is disposed beside the car 5 in this manner, a driving machine 41, and the counterweight 34, etc., can also be disposed more efficiently, enabling overall installation space to be made even more compact.

Embodiment 15

Figure 22:
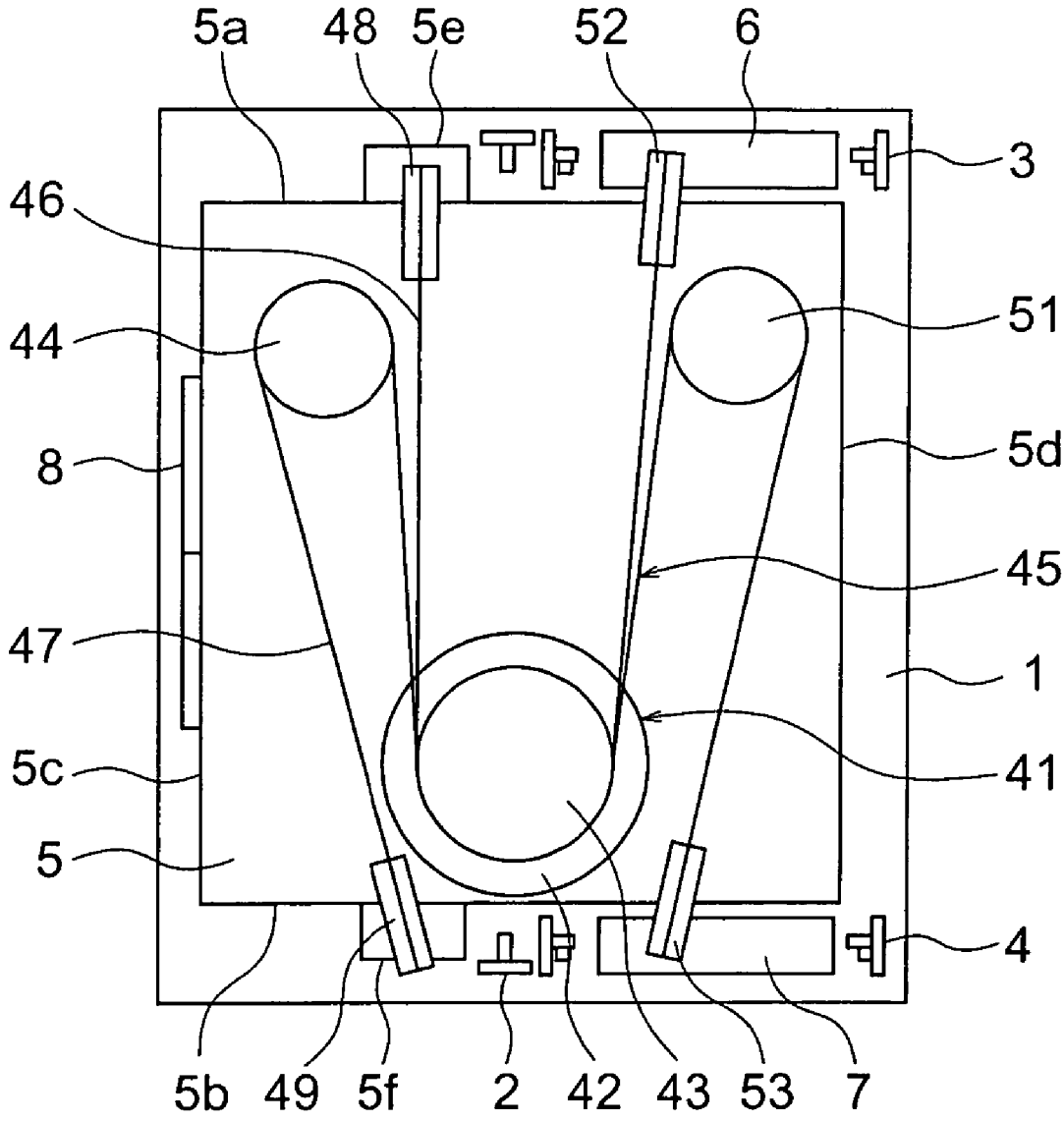
FIG. 22 is a plan showing an elevator apparatus according to Embodiment 15 of the present invention.
Figure 23:
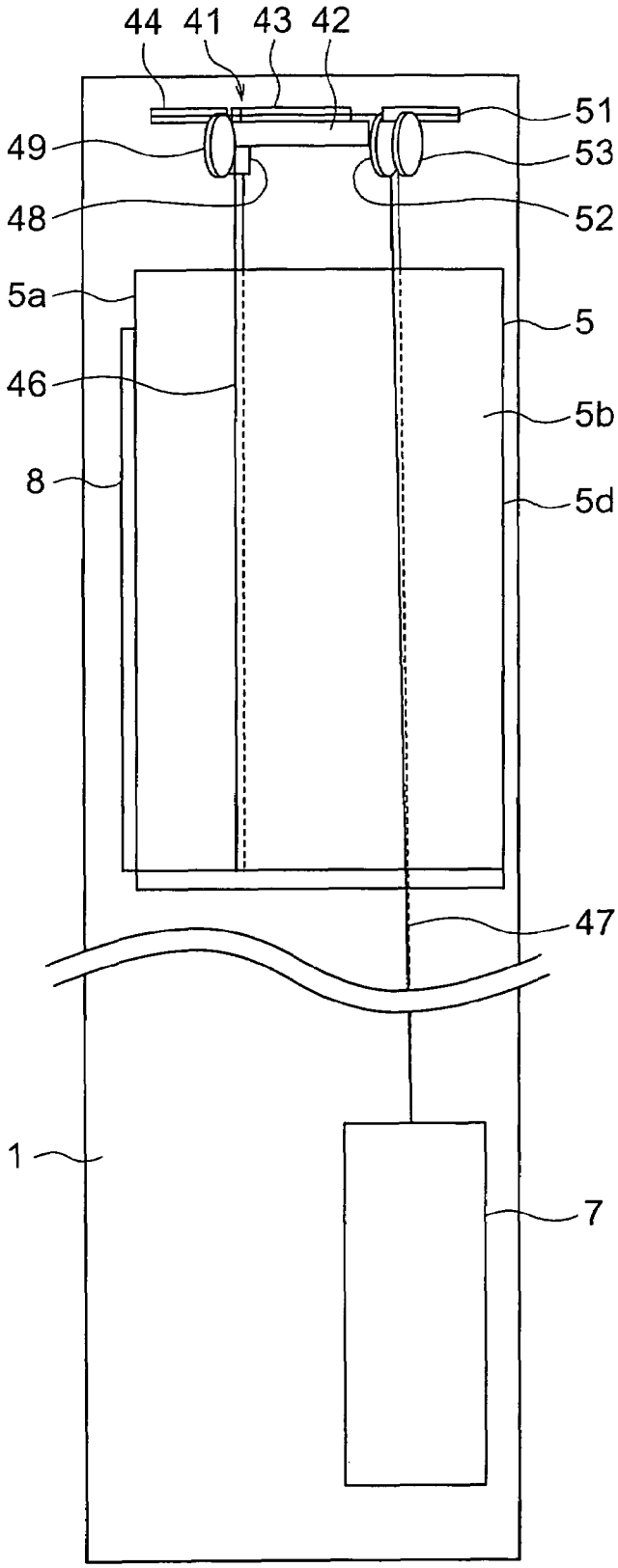
FIG. 23 is a side elevation showing the elevator apparatus in FIG. 22.

Next, FIG. 22 is a plan showing an elevator apparatus according to Embodiment 15 of the present invention, and FIG. 23 is a side elevation showing the elevator apparatus in FIG. 22. In the figure, a counterweight deflection pulley 51 is disposed in an upper portion inside a hoistway 1. The counterweight deflection pulley 51 is disposed such that an axis of rotation thereof extends vertically (including generally vertically).

In a similar manner to Embodiment 1, a first counterweight 6 is disposed near a first side surface portion 5*a* of a car 5, and a second counterweight 7 is disposed near a second side surface portion 5*b*. A first counterweight return pulley 52 for directing first main ropes 46 toward the first counterweight 6 is disposed in an upper portion inside the hoistway 1. The first counterweight return pulley 52 is disposed directly above the first counterweight 6. A second counterweight return pulley 53 for directing second main ropes 47 toward the second counterweight 7 is disposed in an upper portion inside the hoistway 1. The second counterweight return pulley 53 is disposed directly above the second counterweight 7.

First and second counterweight return pulleys 52 and 53 are disposed such that axes of rotation thereof extend horizontally. Second end portions of the first main ropes 46 are connected to an upper portion of the first counterweight 6. Fourth end portions of the second main ropes 47 are connected to an upper portion of the second counterweight 7.

Using an elevator apparatus of this kind, the driving machine 41, and the counterweights 6 and 7, etc., can also be disposed more efficiently, enabling overall installation space to be made even more compact.

Moreover, in the above example, the second end portions of the first main ropes 46 are connected to the first counterweight 6, and the fourth end portions of the second main ropes 47 are connected to the second counterweight 7, but the second end portions of the first main ropes 46 can also be connected to the second counterweight 7, and the fourth end portions of the second main ropes 47 can also be connected to the first counterweight 6.

Embodiment 16

Figure 24:
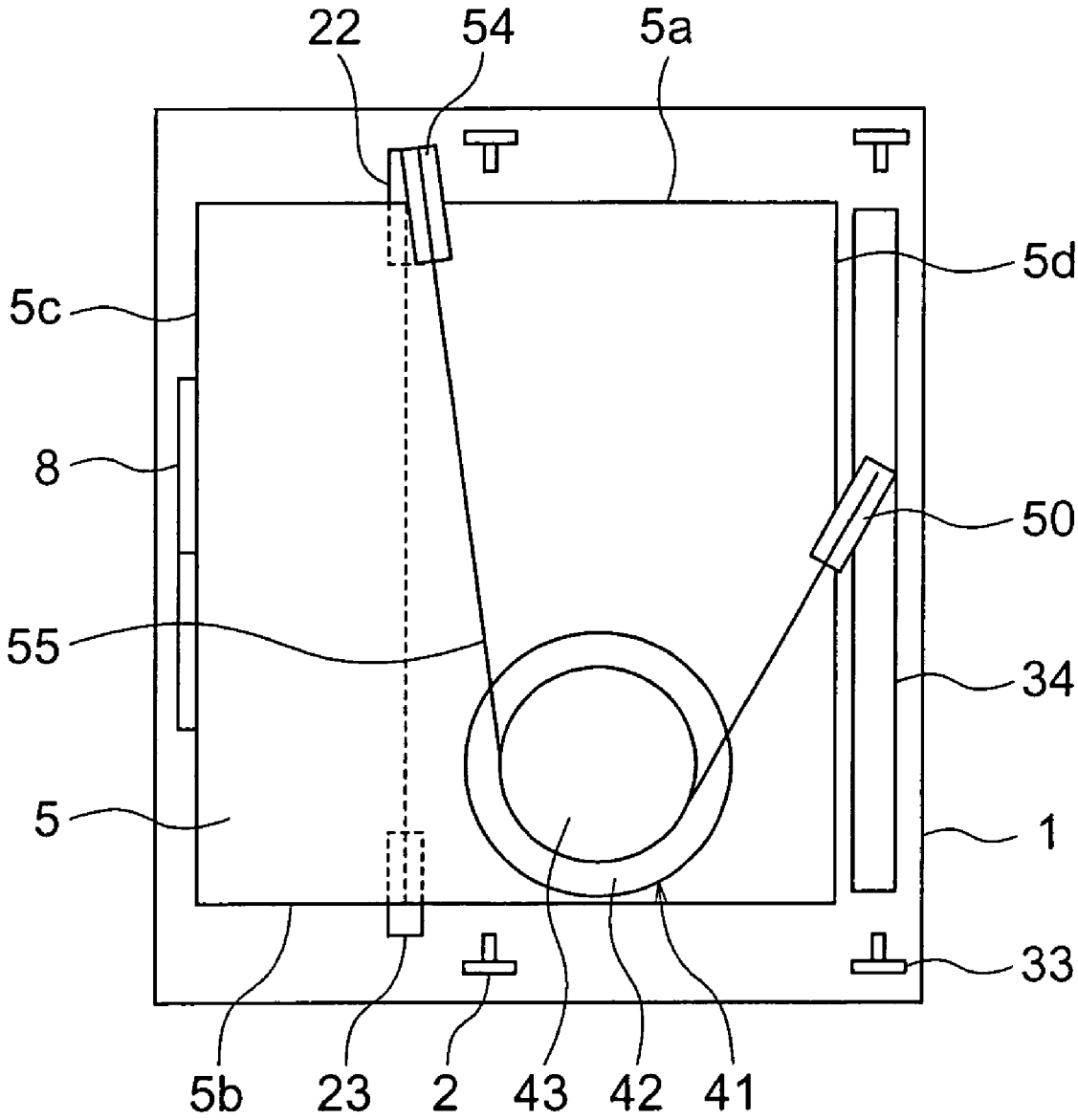
FIG. 24 is a plan showing an elevator apparatus according to Embodiment 16 of the present invention.
Figure 25:
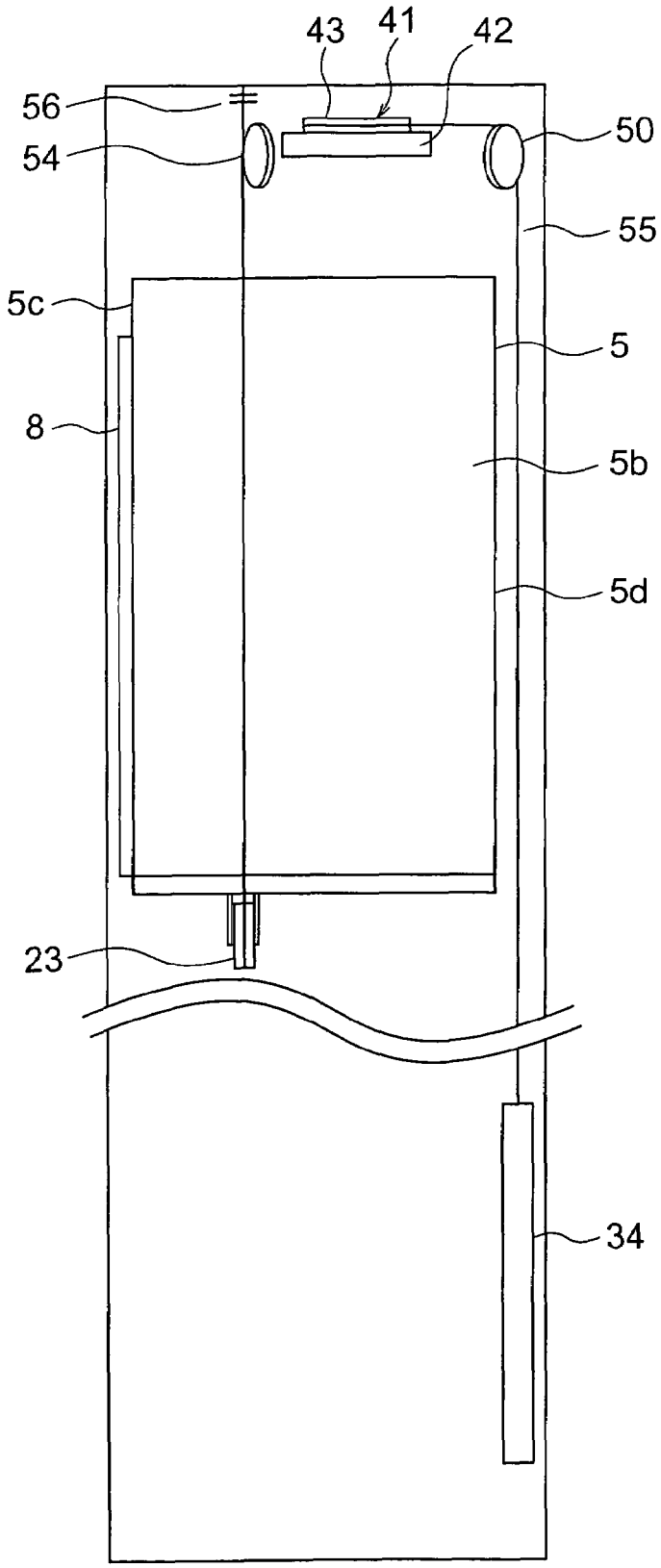
FIG. 25 is a side elevation showing the elevator apparatus in FIG. 24.

Next, FIG. 24 is a plan showing an elevator apparatus according to Embodiment 16 of the present invention, and FIG. 25 is a side elevation showing the elevator apparatus in FIG. 24. In the figures, first and second car suspension sheaves 22 and 23 are mounted to a lower portion of a car 5. The car 5 and a counterweight 34 are suspended by a main rope body constituted by a plurality of main ropes 55 (only one is shown in the figures).

A car return pulley 54 for directing the main ropes 55 extending from a drive sheave 43 toward the first car suspension sheave 22 is disposed in an upper portion inside the hoistway 1. The car return pulley 54 is disposed such that an axis of rotation thereof extends horizontally. A rope connecting portion 56 is fixed to an upper portion inside the hoistway 1. The rope connecting portion 56 may also be disposed on a supporting frame supporting a driving machine 41.

The main ropes 55 have: first end portions connected to the rope connecting portion 56; and second end portions connected to an upper portion of the counterweight 34. The main ropes 55 are wound sequentially around the second car suspension sheave 23, the first car suspension sheave 22, the car return pulleys 54, the drive sheave 43, and a counterweight return pulley 50 from the first end portions to the second end portions.

Consequently, the car 5 is suspended inside the hoistway 1 by the main ropes 55 using a two-to-one (2:1) roping method, and the counterweight 34 is suspended inside the hoistway 1 by the main ropes 55 using a one-to-one (1:1) roping method.

Using an elevator apparatus of this kind, the driving machine 41, and the counterweight 34, etc., can also be disposed more efficiently, enabling overall installation space to be made even more compact.

Moreover, in Embodiments 1 through 16, resin-coated ropes in which an outer layer coating body composed of a high-friction resin material is disposed on an outer peripheral portion can be used for ropes constituting the main rope body. By using resin-coated ropes of this kind, a large traction force can be ensured with a reduced contact angle. Since resin-coated ropes enable flexibility to be increased more than simple steel ropes, diameters of drive sheaves can be reduced.

In all of the elevator apparatuses in Embodiments 1 through 16, equipment disposed in upper portions inside the hoistway 1 (driving machines, return pulleys, deflection pulleys, etc.) can be modularized by mounting them to a shared supporting frame.

In addition, in Embodiments 1 through 16, driving machines are disposed such that drive sheaves are positioned on upper portions of driving machine main bodies, but driving machines may also be disposed in reverse, such that drive sheaves are positioned on lower portions of driving machine main bodies.

What is claimed is:

1. An elevator apparatus comprising:

a first driving machine having a first drive sheave, the first driving machine being disposed in an upper portion of a hoistway;

a second driving machine having a second drive sheave, the second driving machine being disposed in an upper portion of the hoistway;

a car raised and lowered inside the hoistway by a driving force from the first and second driving machines;

a counterweight raised and lowered inside the hoistway by a driving force from the first and second driving machines;

suspending means wound around the first and second drive sheaves, the suspending means suspending the car and the counterweight inside the hoistway;

a first car return pulley disposed in an upper portion of the hoistway, the first car return pulley directing the suspending means from the first drive sheave to the car;

a first counterweight return pulley disposed in an upper portion of the hoistway, the first counterweight return pulley directing the suspending means from the first drive sheave to the counterweight;

a second car return pulley disposed in an upper portion of the hoistway, the second car return pulley directing the suspending means from the second drive sheave to the car;

a second counterweight return pulley disposed in an upper portion of the hoistway, the second counterweight return pulley directing the suspending means from the second drive sheave to the counterweight;

a first deflection pulley disposed in an upper portion of the hoistway, a portion of the suspending means between the first drive sheave and the first car return pulley being wound around the first deflection pulley;

a second deflection pulley disposed in an upper portion of the hoistway, a portion of the suspending means between the second drive sheave and the second car return pulley being wound around the second deflection pulley, wherein:

the first and second driving machines are disposed horizontally such that axes of rotation of the first and second drive sheaves extend vertically.

2. The elevator apparatus according to claim 1, further comprising:

a car suspension sheave mounted to the car; and a counterweight suspension sheave mounted to the counterweight, the suspending means being wound endlessly around the first drive sheave, the first deflection pulley, the first car return pulley, the car suspension sheave, the second car return pulley, the second deflection pulley, the second drive sheave, the second counterweight return pulley, the counterweight suspension sheave, and the first counterweight return pulley.

3. An elevator apparatus comprising:

a first driving machine having a first drive sheave, the first driving machine being disposed in an upper portion of a hoistway;

a second driving machine having a second drive sheave, the second driving machine being disposed in an upper portion of the hoistway;

a car raised and lowered inside the hoistway by a driving force from the first and second driving machines;

a counterweight raised and lowered inside the hoistway by a driving force from the first and second driving machines;

suspending means wound around the first and second drive sheaves, the suspending means suspending the car and the counterweight inside the hoistway; and a control apparatus for controlling the first and second driving machines by operating modes including a double operating mode in which the first and second driving machines are both driven simultaneously, and a single operating mode in which only one of the first and second driving machines is driven.

4. The elevator apparatus according to claim 1, wherein the first driving machine and the second driving machine are disposed directly above the car and arranged in a vicinity of an edge of the car opposite to the counterweight in a plane projected vertically.

5. The elevator apparatus according to claim 1, wherein the first counterweight return pulley, the second counterweight return pulley, the first deflection pulley and the second deflection pulley are arranged in a line.

6. The elevator apparatus according to claim 1, wherein the first driving machine, the first car return pulley, the first counterweight return pulley and the first deflection pulley, and the second driving machine, the second car return pulley, the second counterweight return pulley and the second deflection pulley are disposed with linear symmetry.

* * * * *